US008190039B2

(12) United States Patent
Iida et al.

(10) Patent No.: US 8,190,039 B2
(45) Date of Patent: May 29, 2012

(54) IMAGE FORMING APPARATUS AND CONTROL SYSTEM

(75) Inventors: Masaharu Iida, Ebina (JP); Yasushi Nakazato, Tokyo (JP); Nekka Matsuura, Yokohama (JP); Konosuke Maruyama, Yokohama (JP); Tetsuo Yamanaka, Tokyo (JP); Hiroyuki Takahashi, Sagamihara (JP)

(73) Assignee: Ricoh Company, Limited, Tokyo (JP)

( * ) Notice: Subject to any disclaimer, the term of this patent is extended or adjusted under 35 U.S.C. 154(b) by 533 days.

(21) Appl. No.: 12/188,590

(22) Filed: Aug. 8, 2008

(65) Prior Publication Data

US 2009/0041481 A1 Feb. 12, 2009

(30) Foreign Application Priority Data

Aug. 10, 2007 (JP) ..... 2007-210520

(51) Int. Cl.
*G03G 15/00* (2006.01)

(52) U.S. Cl. ..... 399/12; 399/15

(58) Field of Classification Search ..... 399/12, 399/15, 72, 81

See application file for complete search history.

(56) References Cited

U.S. PATENT DOCUMENTS

| | | | | |
|---|---|---|---|---|
| 5,930,561 | A | 7/1999 | Hosokawa et al. | |
| 6,236,820 | B1 | 5/2001 | Nakazato et al. | |
| 6,400,917 | B2 | 6/2002 | Nakazato et al. | |
| 6,466,754 | B2 | 10/2002 | Nakazato et al. | |
| 6,580,887 | B2 | 6/2003 | Nakazato et al. | |
| 6,697,588 | B2 | 2/2004 | Nakazato et al. | |
| 6,707,480 | B2 | 3/2004 | Ameyama et al. | |
| 6,760,557 | B2 | 7/2004 | Nakazato et al. | |
| 6,768,886 | B2 | 7/2004 | Nakazato et al. | |
| 6,819,892 | B2 | 11/2004 | Nakazato et al. | |
| 6,820,039 | B2 * | 11/2004 | Johnson et al. | 702/184 |
| 6,917,775 | B2 | 7/2005 | Nakazato et al. | |
| 6,980,757 | B2 | 12/2005 | Nakazato et al. | |
| 7,027,751 | B2 | 4/2006 | Miura et al. | |
| 7,050,739 | B2 | 5/2006 | Nakazato et al. | |
| 7,139,509 | B2 | 11/2006 | Nakazato et al. | |
| 7,251,437 | B2 | 7/2007 | Tamoto et al. | |
| 7,286,786 | B2 | 10/2007 | Nakazato et al. | |
| 7,359,660 | B2 | 4/2008 | Nakazato et al. | |
| 2004/0013442 | A1 | 1/2004 | Suzuki et al. | |
| 2005/0111858 | A1 | 5/2005 | Nakazato | |

(Continued)

FOREIGN PATENT DOCUMENTS

| | | |
|---|---|---|
| JP | 2002-14577 | 1/2002 |

(Continued)

OTHER PUBLICATIONS

Japanese Office Action forJapanese Application No. 2007-210520 dated Mar. 29, 2012 (2 pages).

*Primary Examiner* — David Gray
*Assistant Examiner* — Rodney Bonnette
(74) *Attorney, Agent, or Firm* — Oblon, Spivak, McClelland, Maier & Neustadt, L.L.P.

(57) ABSTRACT

An image forming apparatus includes a replaceable image formation unit. The image forming apparatus includes an input device for inputting a signal representing occurrence of abnormality in one of an output image and the image forming apparatus recognized by an operator, a unit specifying device for specifying an image formation unit to be replaced for resolving the abnormality upon receiving the signal, and a notification device for notifying information related to the replacement unit based on the unit specification result.

19 Claims, 20 Drawing Sheets

U.S. PATENT DOCUMENTS

| | | | | |
|---|---|---|---|---|
| 2005/0163532 | A1* | 7/2005 | Tsuruya et al. | 399/119 |
| 2005/0232646 | A1* | 10/2005 | Yoshizuka et al. | 399/27 |
| 2007/0036583 | A1 | 2/2007 | Nakazato et al. | |
| 2007/0043971 | A1* | 2/2007 | Suzuki | 714/11 |
| 2007/0127934 | A1* | 6/2007 | Shoji et al. | 399/9 |
| 2008/0080874 | A1* | 4/2008 | Murayama et al. | 399/9 |

FOREIGN PATENT DOCUMENTS

| | | |
|---|---|---|
| JP | 2002-174939 | 6/2002 |
| JP | 2002-288367 | 10/2002 |
| JP | 2006-84947 | 3/2006 |
| JP | 2007-114387 | 5/2007 |

* cited by examiner

IMAGE FORMING APPARATUS AND CONTROL SYSTEM

CROSS REFERENCE TO RELATED APPLICATION

This application claims priority under 35 USC §119 to Japanese Patent Application No. 2007-210520, filed on Aug. 10, 2007, the entire contents of which are herein incorporated by reference.

BACKGROUND OF THE INVENTION

1. Field of the Invention

The present invention relates to an image forming apparatus, such as a printer, a facsimile, a multifunctional machine, etc., and a controlling system for controlling the image forming apparatus. In particular, the present invention relates to an image forming apparatus employing a detachable unit, such as a process unit, a fixing unit, etc., and a controlling system for controlling the image forming apparatus.

2. Discussion of the Background Art

As described in the Japanese Patent Application Laid Open No. 2005-128414, it is well known that a portion of an electro-photographic image forming apparatus, such as a copier, a printer, etc., is freely replaced as a replacement unit. As a typical replacement unit, a toner unit that contains toner and a process unit that integrally mounts a photo-conductive member with at least one of a charging section, a developing section, and a cleaning section, or all of image formation devices including a photo-conductive member, a toner container, a charging section, and a developing section or the like are exemplified.

By arranging a replacement unit detachable to and from an image forming apparatus, a user can readily maintain the image forming apparatus by himself (herself). Specifically, since a section of the image forming apparatus is made into a replacement unit and maintenance is executed only by replacing the section in need of the maintenance per unit, usability is improved.

Further, as discussed in the Japanese Patent Application Laid Open No. 2006-201608, a user can designate a time when image quality is to be adjusted in an image forming apparatus. Specifically, a user designates necessity of maintenance in accordance with an importance degree per situation, such as when an electric power is turned on or when a door is open, etc., so that a highly important maintenance is executed without exception, while a less important maintenance is selectively executed by the user.

It is described in the Japanese Patent Application Laid Open No. 2002-288367 that replacement of distribution parts, such as a cartridge, etc., is determined by an instrument control server connected to an image forming apparatus via a network, and determination result is notified to the image forming apparatus.

In such a technology, an electronic lock prohibits a toner cartridge from being detached during communication with the apparatus control server.

The above-mentioned conventional image forming apparatuses can allow the user to readily maintain the image forming apparatus due to employment of the replacement unit. However, it is difficult to determine an appropriate time to replace the replacement unit in the image forming apparatus, because the time varies depending on a preference of a user. Especially, determination of a time for replacing a unit including an image formation element is difficult. For example, a replacement time for a toner unit (e.g. a toner cartridge) is determined based on whether the toner stored therein is completely used up or not. Where as in the process unit, a permission range of deterioration (abnormality) varies depending on the user.

Various technologies of determining a life of the image formation element have conventionally been proposed. For example, the Japanese Patent Application registration No. 3938103 discloses a technology of determining a life of a photo conductive member in accordance with an accumulated bias application time periods per charge waveform.

However, such determination largely varies depending on subjectivity of a user or a usage of the image forming apparatus or the like. For example, a user working at a design office is sensitive even to slight deterioration of image quality. Whereas another user working at a different office allows a large line on an image as far as the image can be output.

Thus, when a life is equally determined using common program developed by a manufacturer regardless of various preferences of the users, the user only allowing a small allowance of image quality deterioration complains that notification of abnormality is late, where as the other user allowing a large allowance of image quality deterioration feels opposite. Thus, both types of the user equally have complaints about that. Accordingly, it is appropriate to respect determination of a user as to if an image quality is abnormal.

Further, a user sometimes cannot recognize a unit to be replaced even recognizing abnormality of a quality of an output image or an apparatus. For example, the user cannot identify when an alien substance sticks to a photo conductive member or when a fixing section includes a cut even though a black line appears on the output image. For example, there does not exist abnormality on the photo conductive member or the fixing section, but a hair dropping on a platen glass of a scanner can sometimes be a cause of the black line. Accordingly, it is appropriate that a manufacturer preferably uses their skill in determining a countermeasure against the abnormality while respecting the determination of the user as to abnormality of image quality. Thus, when the image forming apparatus is maintained, a user and a service person preferably cooperate with each other. However, since the service person generally takes a certain time for visiting a user when the user feels abnormality, the image forming apparatus cannot be operated during the time, so that an apparatus unavailable time takes place.

Further, the Japanese Patent Application Laid Open No. 2006-201608 enables a user to designate a time when image quality is adjusted in an image forming apparatus, but is impossible to convey abnormality felt by the user to the image forming apparatus. Further, it is generally burdensome for a user to assign an importance degree to each of various image qualities. Further, the above-mentioned technology of the Japanese Patent Application Laid Open No. 2002-288367 determines replaceability of a distribution product using an instrument control server connected to the image forming apparatus via the network to improve efficiency of inventory and budget management for expendable supplies, but does not resolve the above-mentioned problems.

SUMMARY OF THE INVENTION

The present invention has been made in view of the above noted and another problems and one object of the present invention is to provide a new and noble image forming apparatus. Such a new and noble image forming apparatus includes a replaceable image formation unit. The image forming apparatus includes an input device for inputting a signal representing occurrence of abnormality in one of an output image and the image forming apparatus recognized by an operator, a unit specifying device for specifying an image formation unit to be replaced to resolve the abnormality upon receiving the signal, and a notification device for notifying the operator of information related to the replacement unit based on the unit specification result.

In another embodiment, an image formation device is provided to form a toner image for image quality determination use on an image carrier or a recording medium. An image-reading device is provided to read the toner image for image quality determination use. The unit-specifying device determines quality of the image and specifies a replacement unit to be replaced based on the determination.

In yet another embodiment, the image-reading device includes a photo sensor arranged in the image forming apparatus.

In yet another embodiment, the image reading device includes a scanner.

In yet another embodiment, the notification device notifies information that the replacement unit is not present.

In yet another embodiment, the unit-specifying device is arranged within the image forming apparatus.

In yet another embodiment, the image forming apparatus is connected to an external control apparatus, and the unit-specifying device is arranged in the external control apparatus.

In yet another embodiment, a lock mechanism is provided to lock the replacement unit in the image forming apparatus. The lock mechanism unlocks the replacement unit when specified by the unit specification device.

In yet another embodiment, a control system is connected via a communication line to plural image forming apparatuses including a replaceable unit. The image forming apparatus includes an input device that inputs a signal representing occurrence of abnormality in one of an output image and the image forming apparatus recognized by an operator, a unit specifying device that specifies an image formation unit to be replaced to resolve the abnormality upon receiving the signal, and a notification device that notifies information related to the replacement unit based on the unit specifying result.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein.

PREFERRED EMBODIMENTS OF THE PRESENT INVENTION

Figure 1:
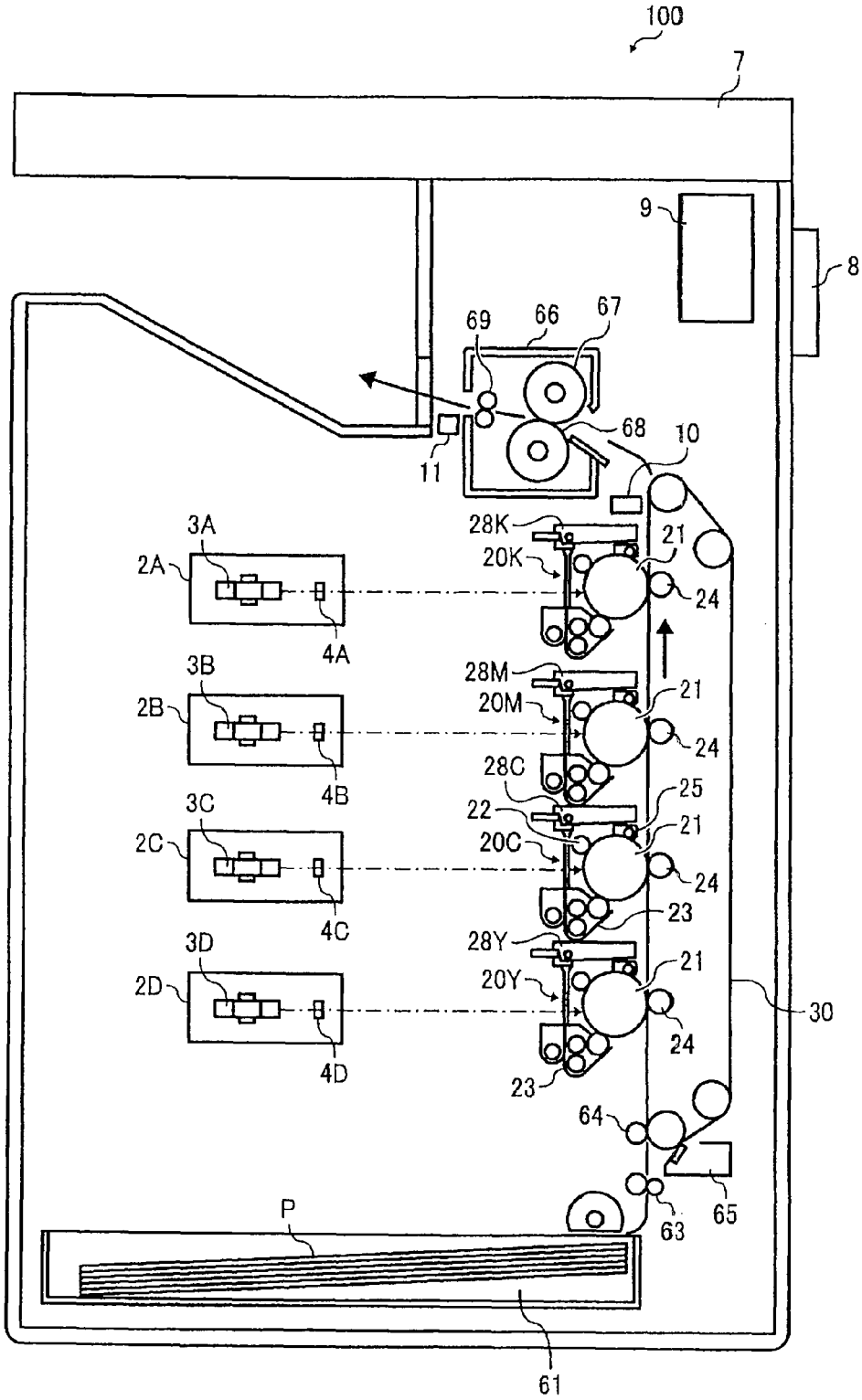
FIG. 1 illustrates an exemplary image forming apparatus according to the first embodiment of the present invention.

Referring now to the drawings, wherein like reference numerals and marks designate identical or corresponding parts throughout several figures, in particular in FIG. 1, an exemplary configuration and an operation of an image forming apparatus according to the first embodiment are initially described.

Plural writing sections 2A to 2D write latent images on plural photo conductive drums 21 (i.e., image bearers) subjected to a charge process in accordance with image information, respectively. These write sections 2A to 2D respectively include optical scanning devices employing plural polygon mirrors 3A to 3D and optical elements 4A to 4D, respectively. Plural LED arrays can be employed in the writing sections instead of the optical scanning devices. A sheet feeding section 61 accommodates and feeds recording mediums P such as printing sheets, OHP sheets, etc., toward an endless transfer belt 30.

The transfer belt 30 attracts, with electrostaticity, and conveys the recording medium P, so that a toner image formed on the photo conductive drum 21 is transferred onto the recording medium P. An adhesion roller 64 and a belt cleaner 65 contact the transfer belt 30. A transfer roller 24 opposes the photo conductive drum 21 via the transfer belt 30 and includes a core metal and a conductive elastic layer coated around the core metal. The conductive elastic layer includes an elastic member obtained by mixing and dispersing conductivity applying agent, such as carbon black, oxide zinc, oxide tin, etc., to elastic material, such as polyurethane rubber, ethylene-propylene-diene polyethylene (e.g. ethylenepropylene diene monomer), etc., having a medium electronic cubic resistance.

A fixing unit 66 includes a heat-applying roller 68 and a pressure-applying roller 67, and fixes the toner image onto the recording medium P by means of pressure and heat. The fixing unit 66 can be detached from an image forming apparatus 100. Plural process units 20Y to 20K are vertically arranged along the transfer belt 30 to form toner images of yellow, cyan, magentas, and black, respectively.

Figure 3:
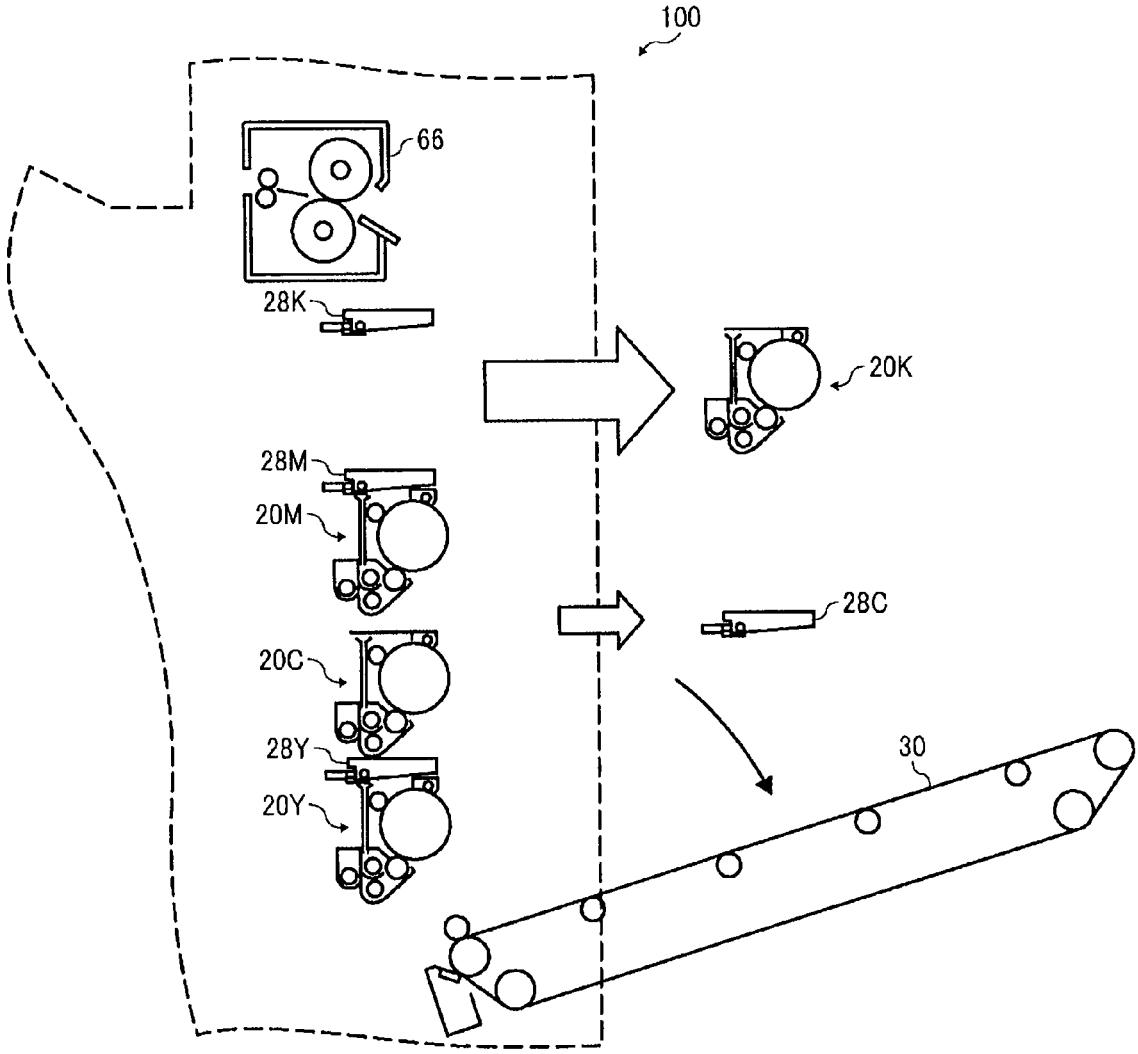
FIG. 3 illustrates an exemplary condition when a replacement unit is replaced.

The process units 20Y to 20K include developer unit 28Y to 28K for supplying the developing section 23 with toner of yellow, cyan, magentas, and black, and magnetic carrier, respectively. These process units 20Y to 20K as well as the developer units 28Y to 28K can be detached from the image forming apparatus 100 by swinging the transfer belt 30 around a rotary shaft thereof as shown in FIG. 3.

The image forming apparatus of this embodiment is a multifunctional type serving as a copier and a printer or the like. When serving as the copier, image information read by the scanner 7 is subjected to A/D conversion, MTF correction, and halftone processing or the like, thereby being converted into write data. When serving as the printer, image information transmitted from a computer or the like in a form of a page description language or a bit map and the like is subjected to image processing and is converted into write data.

When an image is to be formed, plural exposure laser lights are emitted from the write sections 2A to 2D to the process units 20K to 20Y in accordance with black to yellow image information, respectively. Specifically, plural exposure lights emitted from light sources pass through polygon mirrors 3A to 3D as well as optical elements 4A to 4D, and reach the photo conductive drums 21, respectively. Thus, toner images are formed on the photo conductive drums 21 in the process units 20K to 20Y in accordance with the exposure light. The toner images are then transferred on to the recording medium P.

The recording medium P fed from the sheet feeding section 61 stops at a register roller 63 and is conveyed in synchronism with a toner image toward the transfer belt 30. The adhesion roller 64 attracts the recording medium P to the transfer belt 30 by applying a voltage thereto. The recording medium P sequentially passes through the respective process units 20Y to 20K as the transfer belt 30 travels in the direction as shown by an arrow, thereby receiving superimposition of the respective color toner images.

The recording medium P with the color toner image is separated from the transfer belt 30 and reaches the fixing unit 66. The toner image on the recording medium P is sandwiched and fixed onto the recording medium P by the heat applying roller 68 and the pressure-applying roller 67 while being heated. After separation of the recording medium P, the surface of the transfer belt 30 reaches a belt cleaner 65, so that stain or toner sticking onto the surface can be cleaned.

Now, an exemplary process unit and such a developer unit are described in detail with reference to FIG. 2. Since a configuration of each of the process units 20Y to 20K and that of the developer units 28Y to 28K is substantially the same, suffixes Y to K representing mono colors are omitted for the respective process units and developer units in FIG. 2. Similarly, suffixes A to D are omitted for the write section.

Figure 2:
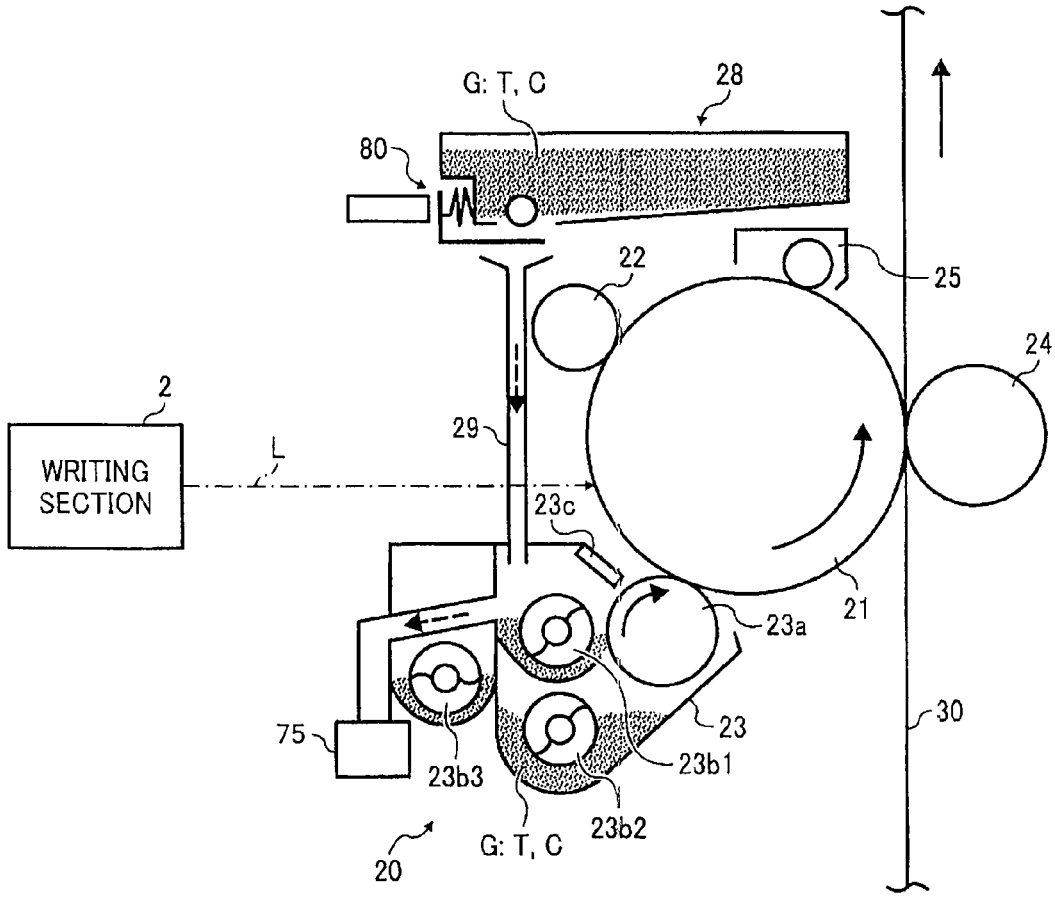
FIG. 2 illustrates an exemplary process unit arranged in the image forming apparatus of FIG. 1.

As shown in FIG. 2, a process unit 20 integrally includes a photo conductive drum 21, a charge section 22, a developing section 23, and a cleaning section 25. The photo conductive drum 21 includes a negative change type organic photo conductive member, and is rotated clockwise by a rotation driving mechanism, not shown.

The charge section 22 includes a metal core and a medium resistance foam urethane layer coated overlying the metal core. The foam urethane layer includes prescribed urethane resin, carbon black serving as conductive particle, sulfuration agent, and foaming agent. As the material of the medium resistance of the charge section 22, rubber material obtained by dispersing conductive material, such as metal oxide, carbon black, etc., to one of urethane, EPDM, butadieneacrylonitrile (NBR), silicone rubber, and isoprene rubber or the like, and material obtained by foaming these material can be utilized. The cleaning section 25 includes a cleaning brush or blade sliding contacting the photo conductive drum 21, and mechanically removes and collects toner not transferred from the photo conductive drum 21.

In the developing section 23, a developing roller 23*a* is arranged in the vicinity of the photo conductive drum 21, and a developing region is formed there between in which a magnetic brush contacts the photo conductive drum 21. The developing section 23 contains two component developer G including toner T and carrier C, and develops a latent image formed on the photo conductive drum 21 into a toner image.

The developing section in this embodiment is supplied with fresh carrier (i.e., developer G) from the developer unit 28, and ejects deteriorated developer G to an agent container 75 externally arranged. As shown in FIG. 2, the developer unit 28 contains developer G (toner T and carrier C) to be supplied to the developing section 23. The developer unit 28 serves as a toner unit for supplying fresh toner T and a supplying device for supplying the fresh carrier C to the developing section 23. Specifically, in accordance with information of toner density (e.g. a ratio of toner in the developer G) detected by a magnetic sensor arranged in the developing section 23, a shutter mechanism 80 is open and closed, so that developer is appropriately supplied from the developer unit 28 to the developing section 23.

A supplying pipe 29 is provided to credibly guide the developer G (T and C) supplied from the developer unit 28 to the developing section 23. Thus, the developer G ejected from the developer unit 28 is supplied through the supply pipe 29. Three conveyance screws 23*b*1 to 23*b*3 circulate, stir and mix the developer G contained in the developing section 23 in a lengthwise direction.

Now, an exemplary image forming process executed on the photo conductive drum 21 is described with reference to FIG. 2. When driven rotated counterclockwise, the surface of the photo conductive drum 21 is uniformly electrically charged initially at a charge section 22. Then, the surface of the photo conductive drum 21 with the charge reaches a light emission position in which an exposure light L reaches, so that an exposure process is executed by a write section 2. Specifically, by selectively removing the charge in accordance with image information on the photo-conductive drum 21 by means of the exposure light L, a difference in potent ional is created between a non-image section not receiving the exposure light L and the image section, so that a latent image is formed.

The exposure process causes electrode creation substance to produce electrode in a photosensitive layer of the photo conductive drum 21, and a positive hole cancels electrode charged on the surface of the photo conductive drum 21.

Then, the surface of the photo conductive drum 21 with the latent image reaches a position opposing the developing section 23. The latent image on the photo conductive drum 21 contacts the magnetic brush on the developing roller 23*a*, and is visualized due to attraction of the toner T with the negative charge in the magnet brush. An amount of developer G drawn up by magnetic force of a magnetic pole in the developing roller 23*a* is controlled by a so-called doctor blade 23*c*, and is conveyed to the developing region opposing the photo conductive drum 21. The carrier C having an ear at the developing region sliding contacts the photo conductive drum 21. The toner T mixed with the carrier C has negative charge due to frication with the carrier C, while the carrier C has positive charge. A prescribed bias is applied to the developing roller 23*a* from an electric power source, not shown. Thus, an electric field is formed between the developing roller 23*a* and the photo conductive drum 21, and the toner with the negative charge only selectively contacts the image section on the photo conductive drum 21 under influence of the electric field, so that a toner image is formed.

Then, the surface of the photo conductive drum 21 with the toner image reaches a position opposing the transfer belt 30 and transfer roller 24. The toner image on the photo conductive drum 21 is transferred onto a recording medium P conveyed to the position in synchronism with the toner image. The transfer roller 24 receives a prescribed voltage. Then, the recording medium P with the toner image passes through the fixing unit 66 and is ejected to an outside via the ejection roller 69.

The toner T remaining on the photo conductive drum 21 not transferred onto the recording medium P in the transfer process reaches a position opposing the cleaning section 25 sticking to the photo conductive drum 21.

The non-transfer toner on the photo conductive drum 21 is removed and collected by the cleaning section 25. The surface of the photo conductive drum 21 then passes a charge removal section, not shown, so that a series of the image forming process is completed.

Now, an exemplary replacement unit replaceable from the image forming apparatus 100 is described with reference to FIGS. 3 and 4. As shown in FIG. 3, the image forming apparatus 100 mainly includes plural process units 20Y to 20K, developer units 28Y to 28K, and a fixing unit 66 as replacement units.

Specifically, when the process units 20Y to 20K and the developer units 28Y to 28K are to be replaced with another, a door, not shown, arranged in the image forming apparatus 100 is initially open. Then, the transfer belt unit 30 is swung in a direction as shown by an arrow in FIG. 3 around a roller shaft. Thus, when viewed from an operator, the developer units 20Y to 20K and the developer units 28*y* to 28K are partially exposed to the operator side.

Figure 4A:
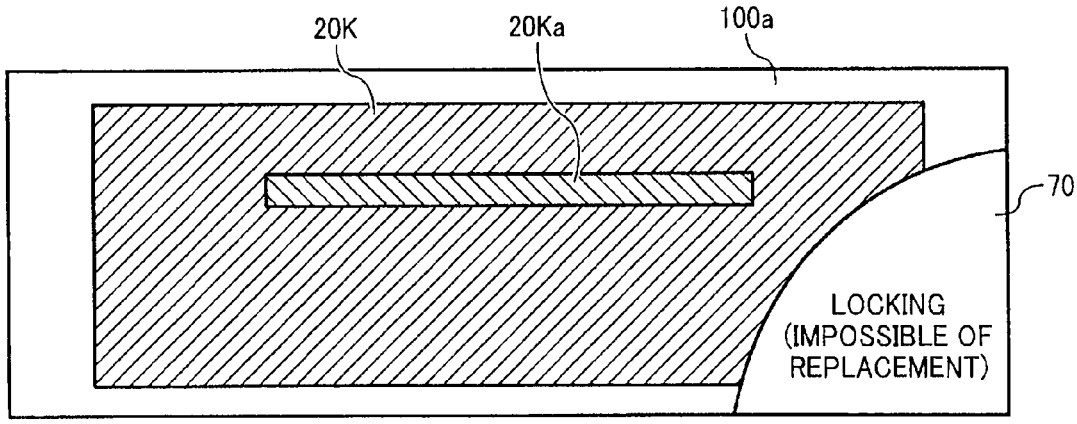
FIGS. 4A and 4B collectively illustrate an exemplary condition when a replacement unit is attached to the image forming apparatus.
Figure 4B:
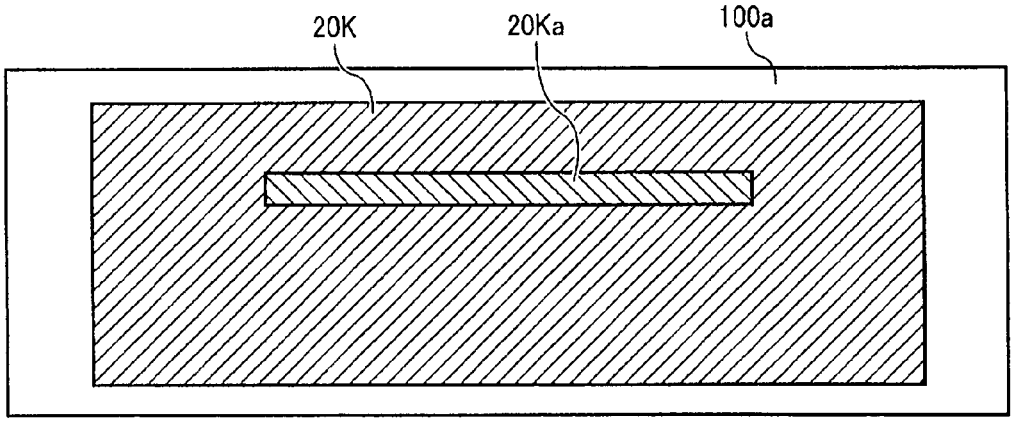

Among the plural replacement units 20Y to 20K and 28Y to 28K thus exposed, an applicable replacement unit or units are prohibited from being detached from the image forming apparatus 100 by means of a lock mechanism. Specifically, as shown in FIG. 4A, when a black use process unit 20K is determined as not to be replaced, a lock plate 70 is arranged at a position to block detachment of the process unit 20K. The lock plate 70 includes messages indicative of a locking condition and impossibility of replacement. Thus, the operator can visually recognize the impossibility of the replacement of the process unit 20K. Whereas when the black use process unit 20K is determined to be replaced as shown in FIG. 4B, the lock plate 70 is moved, for example, to a blind position from the operator for allowing unlocking thereof. Thus, the process unit 20K can be grasped and withdrawn by handle 20Ka through an opening 100*a* of the image forming apparatus 100 toward the operator side in a direction as shown by an arrow in FIG. 3. A determination device as descried later in detail executes such determination for replacement.

Figure 5A:
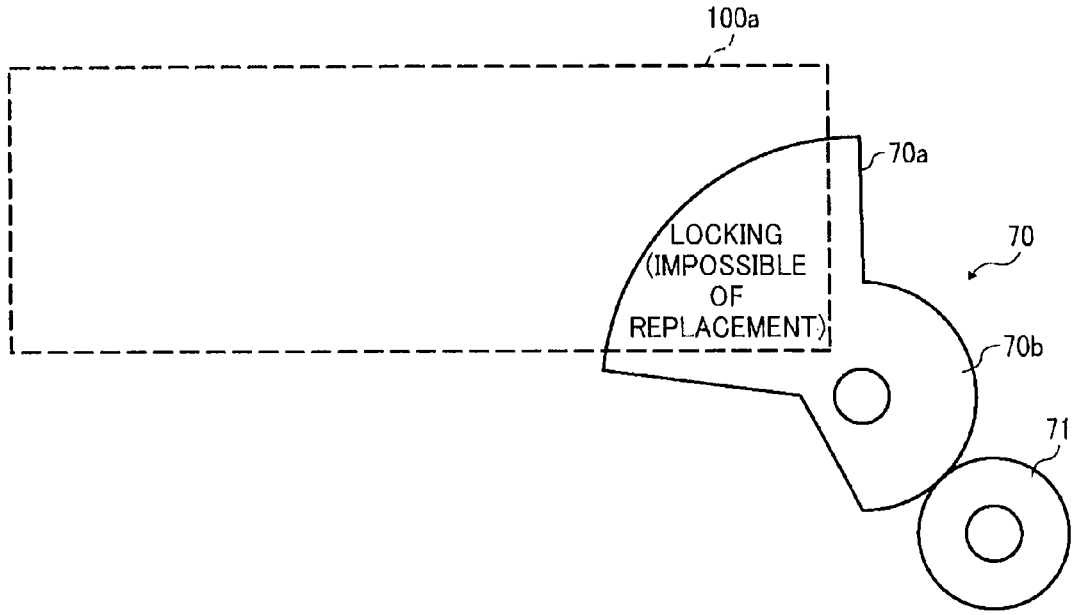
FIGS. 5A and 5B collectively illustrate an exemplary lock mechanism of the replacement unit.
Figure 5B:
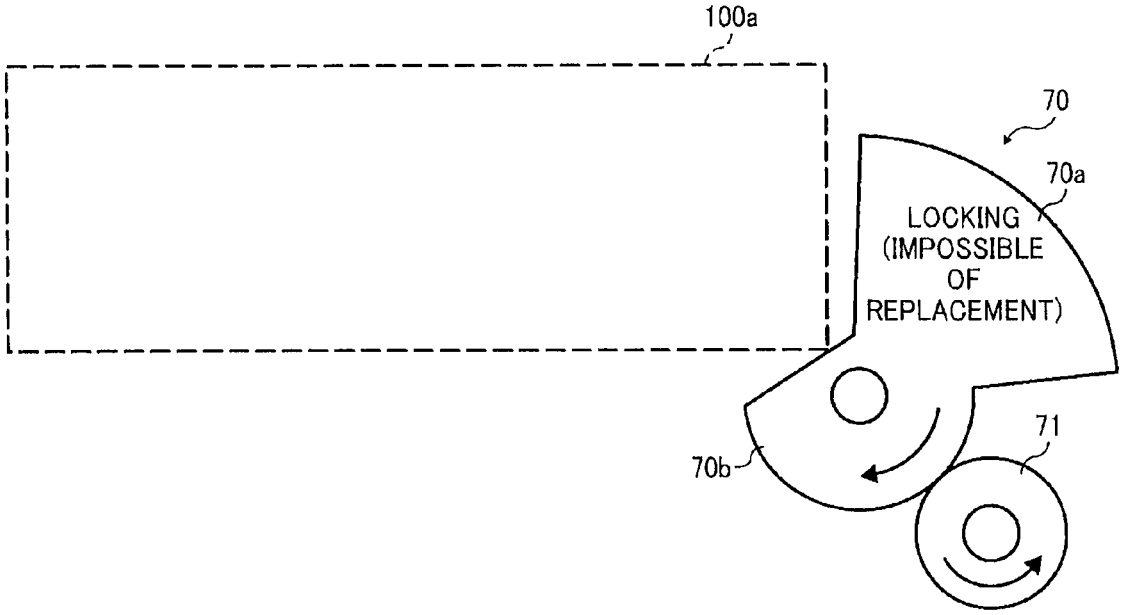

The above-mentioned lock mechanism is described more in detail with reference to FIGS. 5A and 5B. As shown, the lock mechanism includes a lock plate 70 having a display section 70*a* and a gear section 70*b*, a driving gear 71 meshed with the gear section 70*b*, and a stepping motor, not shown, for driving the driving gear 71. When the determination device in the control section determines that a replacement unit is not to be replaced, the lock plate 70 is swung by the stepping motor when the stepping motor rotates a prescribed angle to the position, in which the lock plate 70 blocks detachment of the replacement unit. Such a position serves as a default position. Whereas in FIG. 5B, when the determination device determines that a replacement unit is to be replaced, the stepping motor swings the lock plate 70 when the stepping motor rotates a prescribed angle to the position, in which the lock plate 70 allows the operator to detach the replacement unit.

Further, when the fixing unit 66 is to be replaced, a door, not shown, of the image forming apparatus 100 is open, and the fixing unit 66 is partially exposed to the operator. When it is determined by the determination device that the fixing unit 66 is not to be replaced, the lock mechanism blocks detachment of the fixing unit 66 from the image forming apparatus 100. Whereas when it is determined by the determination device that the fixing unit 66 is to be replaced, the lock mechanism is released for the fixing unit 66.

An erroneous replacement causes waste of expendable cost and ill influence to resource environment. However, since the lock mechanism is provided per the replacement unit, erroneous replacement of the replacement unit not to be replaced by the operator can be credibly prevented.

Further, it is preferable to prohibit the lock plate 70 from swinging when the door of the image forming apparatus 100 is open. Because, it can be prevented that the operator erroneously touches and is injured by the swinging lock plate 70. Further, the lock mechanism can be arranged other than the operator side, such as a rear side, left and right side, etc., different from the above-mentioned embodiment. In such a situation, since the operator does not touch the lock mechanism with any provability, the lock mechanism can safely be operated even if the door of the image forming apparatus is open.

Further, different from the above-mentioned embodiment, a control section provided in a central control apparatus connected to the image forming apparatus 100 via a communication line can determine necessity of replacement.

Now, an exemplary maintenance executed in the image forming apparatus 100 is described. An operation panel 8 is provided on the image forming apparatus 100, and includes an abnormality notification button 8*b* as an input device for conveying intent of a user when the user recognizes abnormality in one of an output image and the image forming apparatus 100 and wishes to resolve the abnormality. Specifically, when the user feels necessity of maintenance, abnormality notification is input to the image forming apparatus 100 by depressing the abnormality button 8*b* on the operation panel 8.

Figure 6:
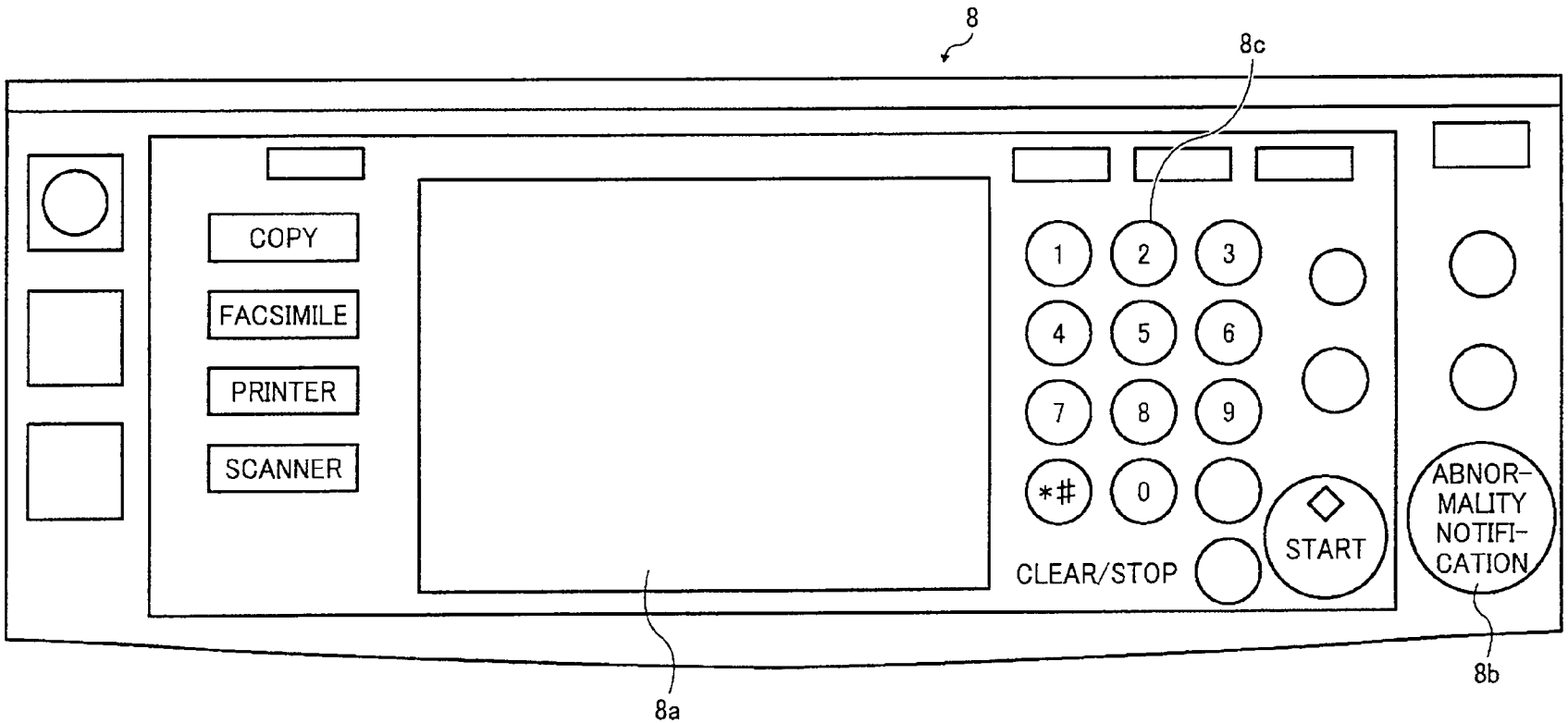
FIG. 6 illustrates an exemplary operation panel.

As shown in FIG. 6, the operation panel 8 allows the user to give instructions to the image forming apparatus 100 or provides information to the user. The instructions from the user include a number of output sheets for a copy function, a simplex or duplex output mode, a staple mode, an input of a transmission destination, or the like. The instructions from the image forming apparatus 100 to the user include information representing a standby state for printing, and a method of dealing sheet jam trouble or the like. The instruction from the user to the image forming apparatus 100 is executed by touching the liquid crystal panel 8*a* or depressing ten pad keys 8*c*. The information provided from the image forming apparatus 100 to the user is displayed on the liquid crystal panel 8*a*. An abnormality notification button 8*b* is arranged on the operation panel 8, so that the user can convey his or her concern about abnormality of one of the image forming apparatus 100 and the output image.

The abnormality recognized by the user includes image quality deterioration, such as a poor line image, image density decrease, strange sound, delayed start up, or the like, but varies per user. Advantage of notification of the abnormality from the user by himself (or herself) is described below in mote detail. A level of recognizing deterioration of image quality varies depending on a situation of a user. Specifically, some user regard color as important, while others are sensitive to background stein or lines. Such tendency comes from either personal sensitivity of the user or quality of an output image. For example, a user A who frequently outputs monochrome images of a table, in which fine numerals are written, is generally nervous about lines and is not nervous about color deterioration due to few outputs of color images. In contrast, a user B who outputs a large amount of color natural images, such as photographs, etc., is generally sensitive to color deterioration. Thus, if the image forming apparatus 100 equally determines image deterioration for all of the users, some user is dissatisfied.

For example, a change in density is detected by a density sensor by detecting a pattern formed on a transfer belt at a prescribed time in the image forming apparatus 100. When the density change is detected in such an image forming apparatus 100, a bias or the like applied to the charge section or the developing section is adjusted as a process control. However, some user A disregarding color as important is dissatisfied, because the process control starts even if he or she does not fee that image quality deteriorates, and he or she cannot use the image forming apparatus 100. In contrast, the user B sensitive to the color probably recognizes deterioration of image quality before the image forming apparatus 100 recognizes the same. To satisfy such a user, a highly precise sensor can be arranged.

However, it is costly and the image forming apparatus 100 becomes increasingly unavailable for the user. Further, when the abnormality of image deterioration, such as strange sound, strange smell, etc., is detected by the image forming apparatus 100, an expensive parts, such as a sound sensor, a strange smell sensor, etc., is needed.

In view of this, it is preferable that the user him or herself notifies abnormality, which is differently felt per user. Thus, the image forming apparatus 100 includes the abnormality notification button 8*b* as an input device, so that the image forming apparatus 100 can readily recognize abnormality notification from the user. Instead of the abnormality notification button 8*b*, a liquid crystal panel 8*a* as a touch panel can be employed to receive such an input. Otherwise, a lever can be employed to receive such an input when operated. A dial can also be used to receive such an input when rotated. The messages displayed on the button 8*b* can include the other information, such as presence of problem, request for unit replacement or maintenance, etc. Further, the user can input a type of abnormality. For example, by arranging plural abnormality buttons corresponding to types of abnormalities, intent of the user can be specifically recognized by the image forming apparatus 100.

Together with the above-mentioned abnormality notification executed by the input of the user through the abnormality notification button 8*b*, the image forming apparatus 100 itself (e.g. a process control) can additionally recognize the abnormality. Such a device is useful for a user who relies on the image forming apparatus 100 to determine the abnormality.

Now, an exemplary specification device that specifies a replacement unit to be replaced to resolve abnormality when the abnormality notification bottom 8*b* is depressed is described with reference to FIG. 7. Also described is an exemplary notification device that notifies information related to the replacement unit based on the specification of the specification device. The image forming apparatus 100 specifies a replacement unit, which is highly probably a cause of the abnormality, upon receiving the abnormality notification from the user. The image forming apparatus 100 notifies the user of the necessity of replacing the replacement unit.

Now, an exemplary controller 9, in which the specification device and the notification device are arranged, is described with reference to FIG. 7. The controller 9 includes a CPU (a central processing unit) 9*a*, a memory 9*b*, such as a ROM, a RAM, a HDD, etc., and an I/O port 9*c* that communicates information between the controller and an image formation section or a communication line. Also included are a lock control section 9*d* for locking and unlocking the replacement unit in relation to the image forming apparatus 100, a MODEM 9*e* for executing communications via a communication line, and a network control unit 9*f*. Further included are an image formation control section 9*g* for controlling a scanner 7, an image formation section, and a sheet feeding section and the like.

The CPU 9*a* applies image process filtering to data read by a scanner, and calculates each amount of various biases to be applied during image formation, and specifies a replacement unit to be replaced using algorithm when the replacement unit is to be specified as mentioned later in detail. Specifically, the specification device for specifying the replacement unit is included in the CPU 9*a*. The memory device 9*b* stores a correspondence table describing correspondence between outputs from the environmental sensor and bias amounts, and designates a prescribed bias amount in collaboration with the CPU 9*a*. The memory device 9*b* further functions as a working memory for temporarily storing information such as an output from the sensor when a replacement unit is specified. Further, the memory device 9*b* stores image data read by the scanner 7, inputs from various sensors, and signals (e.g. abnormality notification signals) from the abnormality notification button 8*b*. A prescribed memory region within the memory device 9*b* is assigned to memorize the abnormality notification information and normally stores numeral zero. When the abnormality notification button 8*b* is depressed, an electronic signal is generated and is inputted to the controller, and the information stored in the memory region corresponding to the abnormality notification information is overwritten by numeral one.

Figure 8:
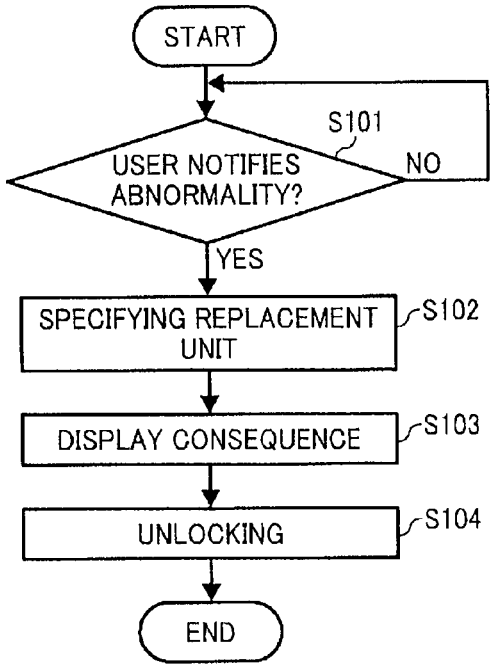
FIG. 8 illustrates an exemplary sequence of abnormality notification.
Figure 9:
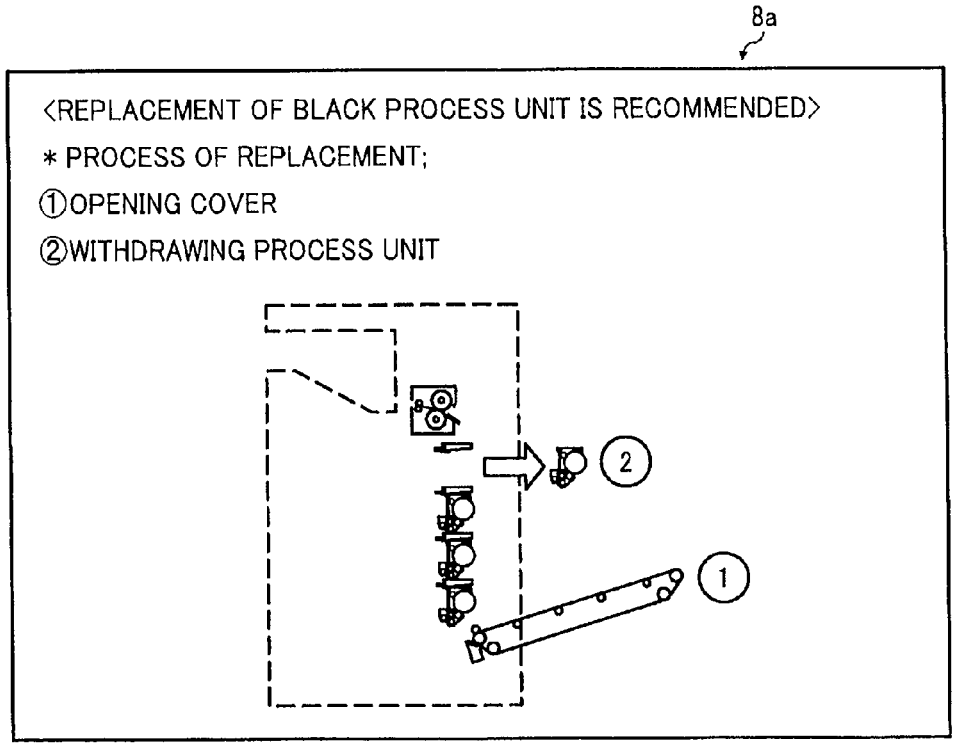
FIG. 9 illustrates exemplary display information displayed on the operation panel when a replacement unit is specified.

An exemplary algorithm implemented by a controller to specify a replacement unit is described with reference to FIG. 8. The CPU 9*a* periodically checks the memory device 9*b* if information stored in the memory region corresponding to the abnormality notification information includes numeral one in step S101. If the information includes numeral zero, the determination is negative (No, in step S101), and the CPU 9*a* simply repeats checking. In contrast, if the determination result is positive in step S101 (i.e., numeral one), a replacement unit specifying operation starts in step S102, and the consequence thereof is displayed in step S103. The most recommending replacement unit is specified in accordance with the algorithm as mentioned later in detail with reference to FIG. 10. As shown in FIG. 9, information, such as a consequence of the determination in step S103, a name and a method of replacing the replacement unit, etc., is notified through the liquid crystal panel 8*a*.

Figure 7:
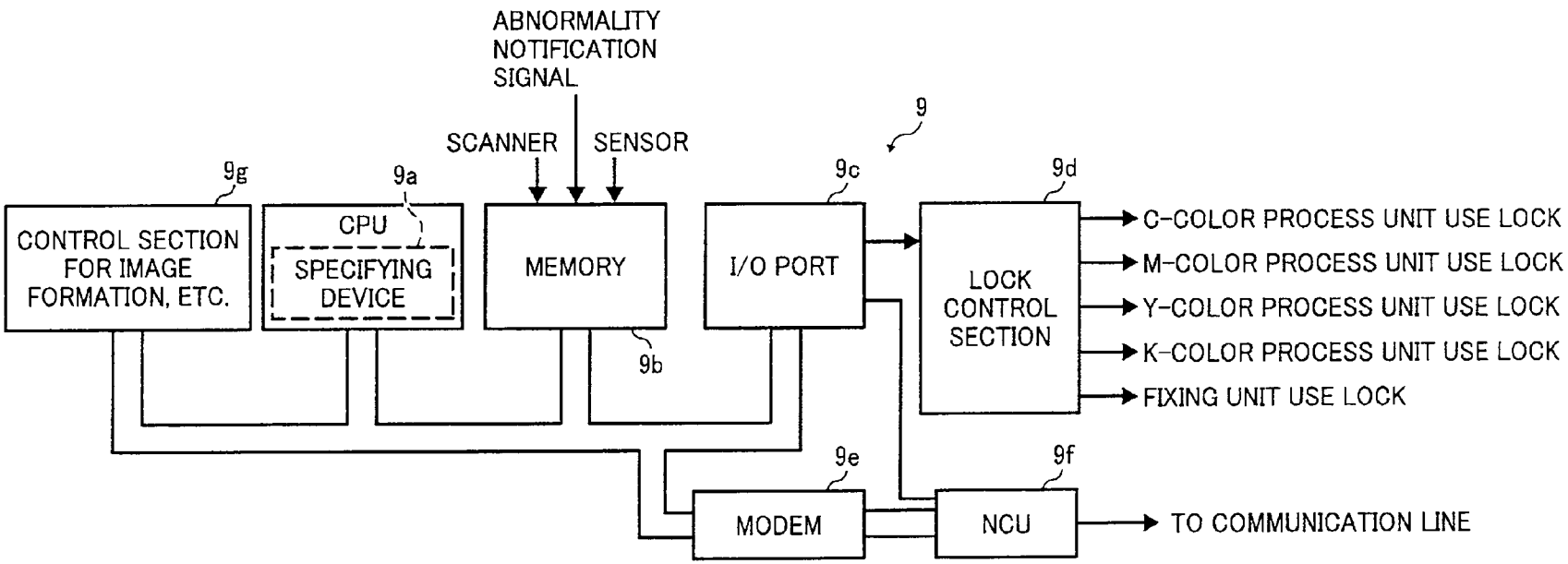
FIG. 7 illustrates an exemplary configuration of a controller.

Further, a signal is transmitted to a lock control section 9*d* as shown in FIG. 7 to control the lock mechanism as described with reference to FIGS. 4 and 5. The lock for the replacement unit to be replaced is unlocked simultaneously when the above-mentioned information is displayed on the liquid crystal panel 8*a* in step S104, predicting user's drawing of the replacement unit. Not only a lock for the replacement unit is recommended to replace, but also locks for all of the replacement units can be unlocked at once. However, in view of usability and avoiding erroneous replacement, the former unlocking manner is preferable.

Figure 10:
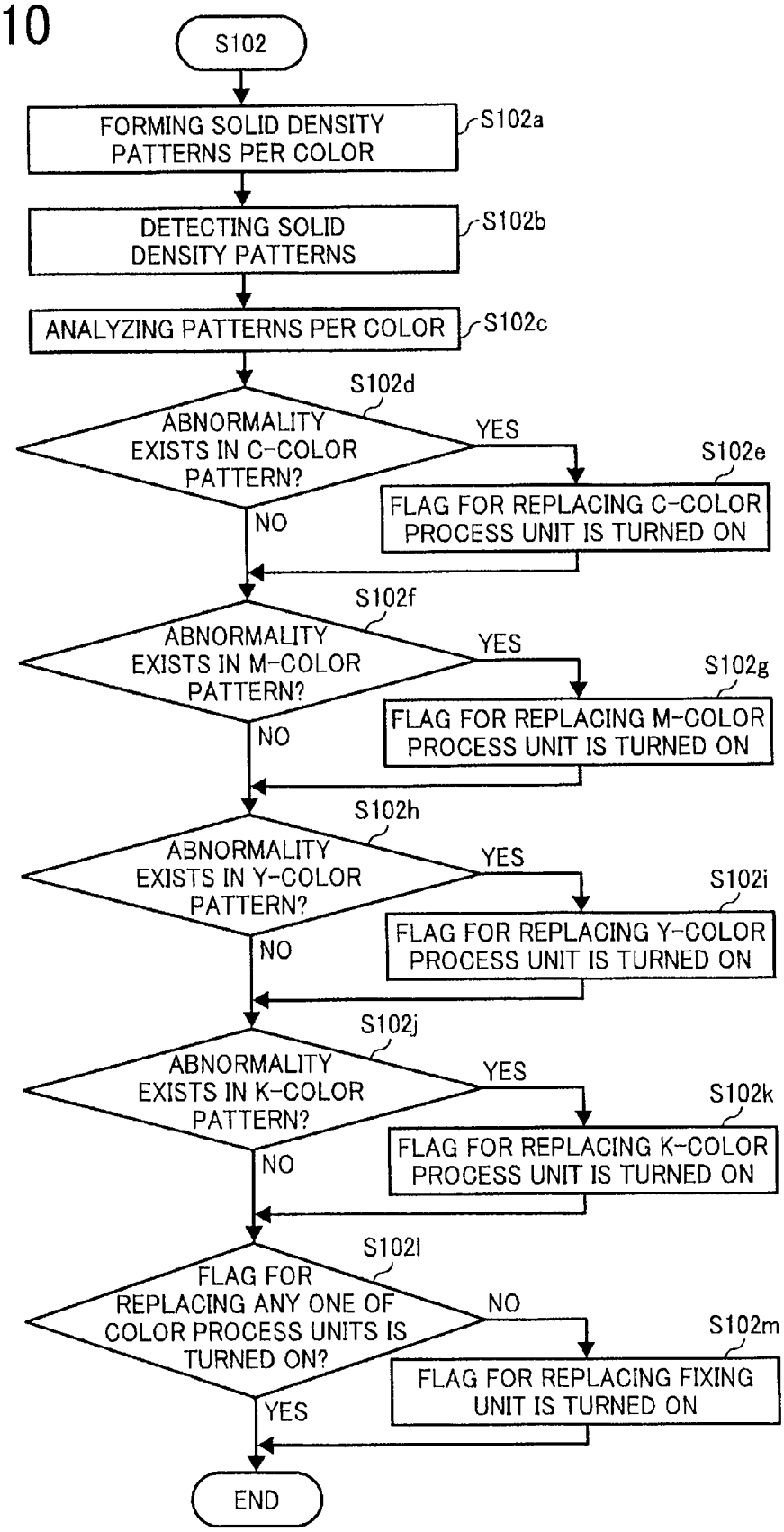
FIG. 10 illustrates an exemplary sequence following the sequence of FIG. 8.

Now, a sequence of specifying a replacement unit to be replaced is described more in detail with reference to sub steps of step S102 in FIG. 10. A series of operations in step S102 represent sub steps of specifying a replacement unit, and are executed by the unit-specifying device included in the CPU 9*a*. Initially, in step S102*a*, an image formation device (e.g. the process unit 20 and the write section 2) forms solid density patterns of respective colors on the transfer belt 30 as an image quality determination use toner image. Specifically, the controller 9 instructs the image formation device to form a prescribed pattern image without instructing the sheet feeding section 61 to feeds sheets. The prescribed pattern image is formed by reading a pattern previously stored in the memory device 9*b*. Specifically, since the above-mentioned process forms the toner image for image quality determination use on the photo conductive drum 21 but the recording medium P is not conveyed, such a toner image is directly transferred onto the transfer belt 30. Then, the respective color density patterns formed on the transfer belt 30 are read by the photo-sensor 10 (e.g. the density sensor as shown in FIG. 1) arranged opposing the transfer belt 30, and are stored in the memory 9*b*.

Figure 11:
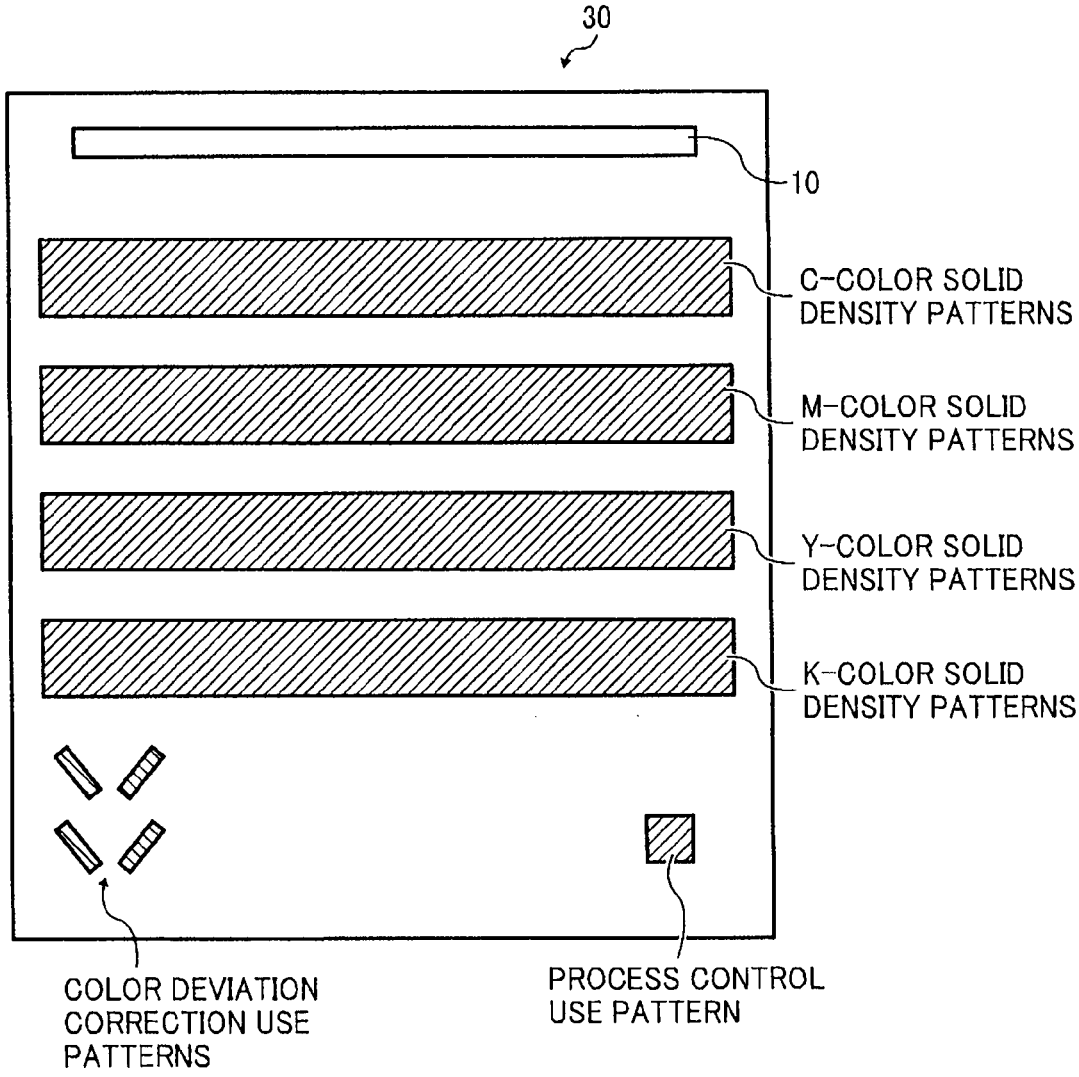
FIG. 11 illustrates an exemplary toner image for image quality determination use.

The respective density patterns are formed over the entire area of the image formable transfer belt 30 as shown in FIG. 11. Further, the photo-sensor 10 includes CCDs arranged in the lengthwise direction, and is capable of detecting density over the entire solid density pattern area. When the process control or color deviation correction is executed, only the CCDs arranged corresponding to positions in which process control use and color deviation correction use patterns are formed are utilized. Thus, by using the photo-sensor 10 for replacement unit specification use and process control and color deviation correction use, the image forming apparatus 100 can be compact and the number of sensors can be decreased. The photo-sensor 10 can include a light reflection type photo-sensor.

Back to FIG. 10, especially, in step S102*b*, the photo-sensor 10 reads and detects the respective density patterns and stores read image information in the memory 9*b* per color. A separation process for separating the read density information into respective colors is executed with reference to a table previously stored in the memory 9*b*. Specifically, the table stores a time T1 starting from when a pattern instruction is provided to when the transfer belt starts a transfer process. Also stored is a time T2 starting from when an image located at a contact point between the process unit (e.g. one of process units (C to K) and the transfer belt 30 reaches a position opposing the photo-sensor 10 as the transfer belt 30 travels. Further included is a time T3 when the solid density pattern passes through the photo-sensor, which is calculated based on an image width of the solid density pattern in the moving direction of the transfer belt. The respective color solid density patterns are simultaneously formed, and density detected from when the time (T1+T2) has elapsed after the pattern formation starts to when (T1+T2+T3) has elapsed thereafter is regarded as that of corresponding color. To avoid color pattern mixture, the time T3 is set shorter than a time taken by a prescribed point on the transfer belt 30 to travel an interval between the axes of the neighboring photo conductive drums 21.

Then, the solid density thus read is subjected to pattern analysis per color in step S102*c*. Among various methods of analyzing the patterns, a method of determining if the sum of density of the solid images or density distribution is deviated by a prescribed level is employed. For example, the method of determining if the sum of density of the solid image is deviated by a prescribed level is used as mentioned below. The density sensor reads density into 256 halftones, and accumulates the entire solid image density. For example, when the density sensor having a reading solution performance of 600 dpi has a width of 20.9 cm, image patterns having a width of 1 cm are arranged in the transfer belt moving direction, and the photo-sensor 10 reads density at a frequency of 100 times per 1 cm in the direction, a number of density data are acculturated as calculated by the following formula:

$$20.9/2.54\times600\times100=4{,}937$$

When the solid image is uniformly formed, the sum of the density is supposed to be calculated as follows:

$$4937\times256(\text{halftones})=1{,}263{,}872$$

The sum of density actually read is compared with the supposed level of density. If the sum of the practical density is smaller by more than 5%, a corresponding color pattern is determined as abnormal. The threshold of density regarded as abnormal can be optionally designated by taking account of a variant in normal image formation density. The reading resolution and the half tone are not limited to 600 dpi and 256, respectively. Thus, density deterioration in the entire image pattern and partial omission of an image pattern can be detected.

Now, another method of determining if distribution of the density of the solid image is deviated by a prescribed level is executed is described.

Initially, density is similarly read as above, and density having a level less than 127 is counted. When more than 247 items of density, which is 5% of the 4,937 items of density, have such a density level, a corresponding color is regarded as abnormal. Thus, density deterioration over the entire image patterns and partial omission of an image area, in which a toner pattern is not formed, can be detected. Second, density is similarly read, and a difference in neighboring density in the main scanning direction is calculated. If the density is even, the difference is to be close to zero. When the sum of difference of the density amounts to more 5% of the below described total density, image omission is significant and abnormality can be recognized. Thus, partial omission of an image area can be detected. Counting can be executed when the difference in density exceeds 20, and abnormality can be recognized when a number of the count exceeds more than 5% of 4,937 items. Now, a third type of determination based on the sum of density and its distribution is described. First, density is similarly read. When the sum of density of more than s % of read data is lower than the prescribed level by more than 5%, or when a density difference of more than 20 from neighboring density exists in more than t % of 4,937 density items, abnormality is recognized. By adjusting the numerals "s" and "t" in accordance with a performance of the image forming apparatus 100, sensitivities to decreasing of image density and to image omission are adjusted.

Further, the controller 9 reads abnormality determination result from the memory device 9*b* per color, and initially determines if the C color pattern is determined as abnormal in step S102*d*. If the abnormality exists, the determination is positive (Yes, in step 102*d*), and a C color process unit replacement flag is turned on. In contrast, if the determination is negative (No, in step 102*d*), the sequence goes to a step S102*f*. Similarly, respective color patterns M to K are determined if being determined as abnormal in steps S102*f*, S102*h*, and S102*j*. If the abnormality exists, respective replacement flags for Y to K color process units are turned on in steps S102*g*, S102*i*, and S102*k*. The turning on of the process unit replacement flag is executed by overwriting the numeral zero by the numeral one to be stored in a region assigned to each of the process unit replacement flags in the memory device 9*b*.

Then, it is determined if any one of C to K color process unit replacement flags is tuned on in step S102*l*. Specifically, respective process unit replacement flags are read from the memory device 9*b*, and an OR calculation is applied thereto. When the result is one, a positive decision (Yes) is provided, where as when that is zero, a negative decision is provided.

When the decision is negative, it is regarded that an image pattern does not include a problem, and the fixing unit 66 is regarded as a cause of image deterioration, so that the fixing unit replacement flag is turned on in step S102*m*. Specifically, the numeral zero stored in a region assigned to a fixing unit replacement flag in the memory device 9*b* is overwritten by that of one. This result is read in the above-mentioned step S103 and is used for displaying the result. As mentioned, a replacement unit to be replaced is specified by the determination device based on the determination result.

A lock mechanism is provided to prohibit the fixing unit from being detached. The locking mechanism is released when a prescribed time period has elapsed after when a determination result representing that a fixing unit 66 should be replaced is displaced in step S103. By delaying a time when the locking mechanism of the fixing unit 66 is released, a user can avoid from a burn by erroneously touching the fixing unit of high temperature just after completion of the fixing process. Specifically, the fixing unit 66 is unlocked after when high temperature of the fixing unit 66 sufficiently lowers. When the replacement unit is specified, fixing temperature is either high or low. Accordingly, a time elapsed after the series of image forming process is completed is counted and a time to release the lock of the fixing unit 66 is preferably determined based on the elapsing time.

According to this embodiment, a user is allowed to forward his or her recognition as to abnormality of an output image or an image forming apparatus, and the image forming apparatus 100 determines which of replacement units is to be replaced. Specifically, a replacement unit is specified in accordance with the abnormality notification from the user. The lock mechanism is not necessarily employed, but it is preferably employed to avoid erroneous replacement of a replacement unit not necessarily replaced. When the replacement unit is locked, the user cannot replace a replacement unit immediately after feeling the abnormality, and has to wait until a replacement unit is specified. However, by specifying a replacement unit within the image forming apparatus for the user, labor of the user and resources consumed by erroneous replacement of the replacement unit can be avoided. Thus, a time necessary for determining a replacement unit to be replaced is advantageously negligible for the user. Further, by maintaining the image forming apparatus 100 to be capable of outputting an image until the replacement unit is specified, the user can output an image not expected to have high image quality.

As mentioned heretofore, when the user recognizes abnormality in either the output image or the image forming apparatus 100, and desires to resolve the abnormality, as well as depresses an abnormality notification button 8*b*, a replacement unit to be replaced to resolve the abnormality is specified while information related to the replacement unit is notified. Thus, when the user feels the abnormality in either the output image or the image forming apparatus 100, maintenance can be accurately performed without loss of time.

Further, a toner unit for supplying only toner T to the developing section 23 can serve as a replacement unit, and the same advantage can be obtained as in the above-mentioned embodiment.

Further, the present invention can be applied to an image forming apparatus in which image formation sections are not made into a process unit, and a photo-conductive drum 21, a charge section 22, a developing section 23, and a cleaning section 25 can be detachable separately from an apparatus.

Figure 12:
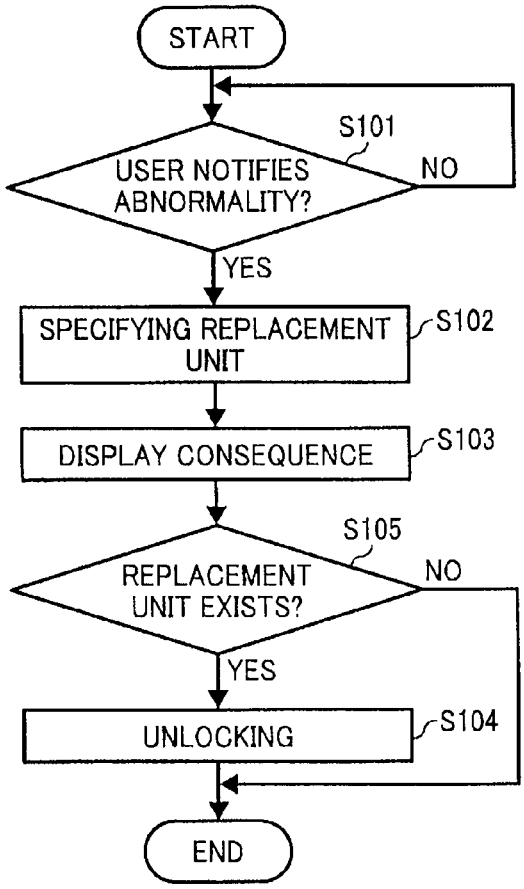
FIG. 12 illustrates an exemplary sequence of abnormality notification executed in an image forming apparatus according to the second embodiment of the present invention.
Figure 13:
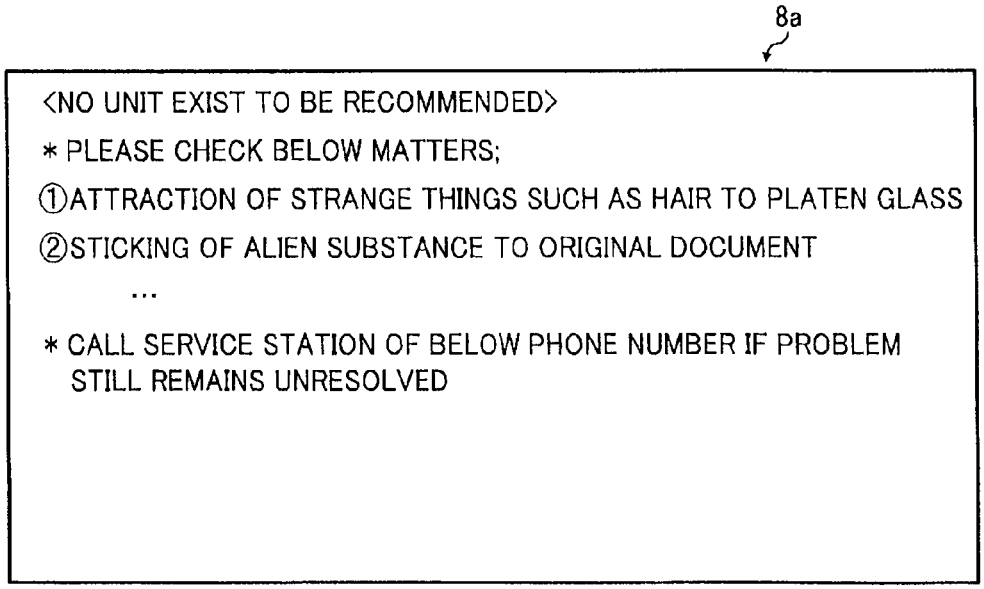
FIG. 13 illustrates an exemplary display of the operation panel when a replacement unit is not specified.
Figure 14:
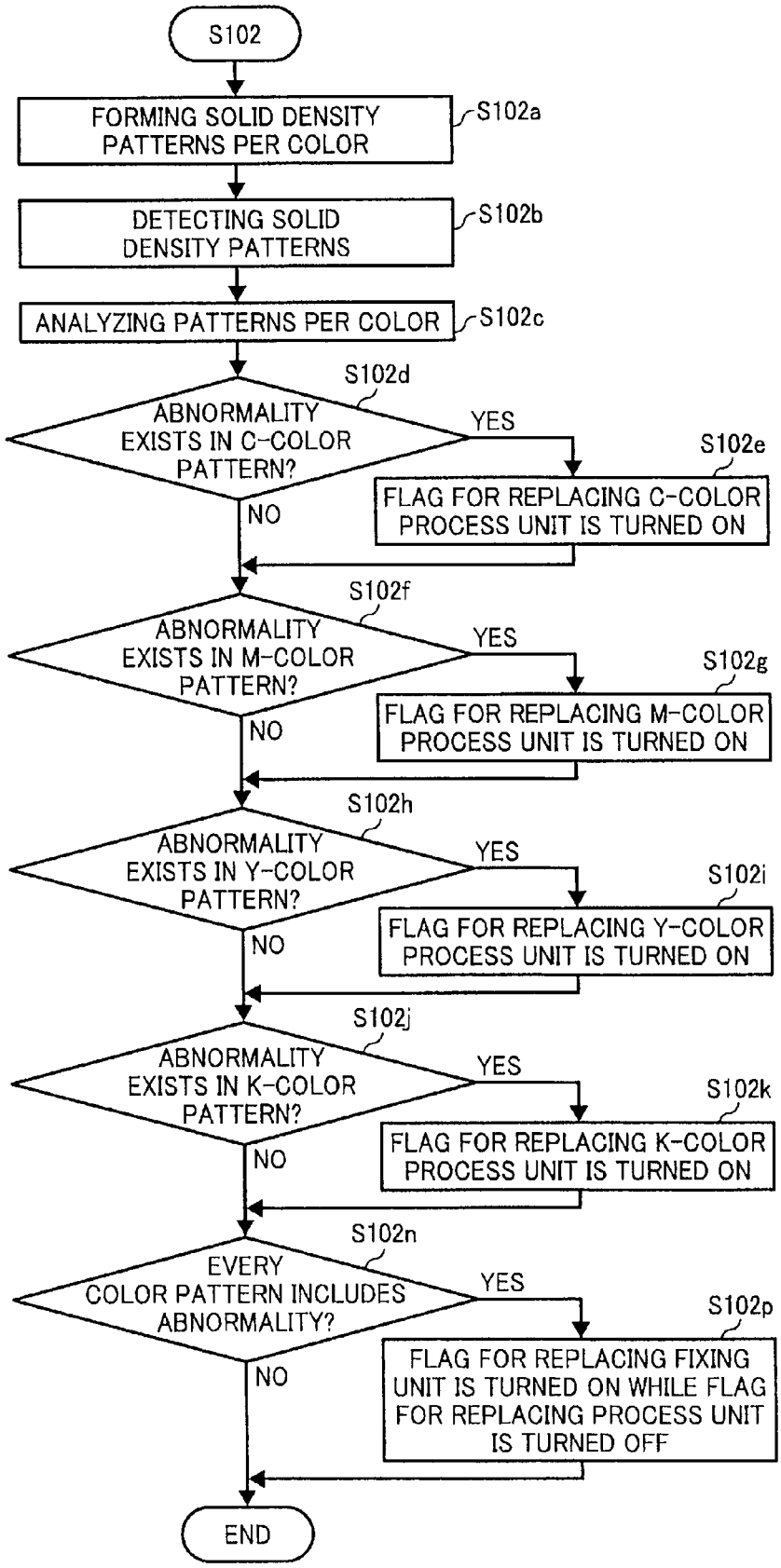
FIG. 14 illustrates an exemplary sequence following the sequence of FIG. 12.

Now, the second embodiment is described with reference to FIGS. 12 to 14. FIG. 12 illustrates exemplary control executed in an image forming apparatus 100 according to the second embodiment. The image forming apparatus 100 of this embodiment is different from that in the first embodiment such that a photo-sensor 11 for a replacement unit specification use does not function as a density sensor 10 for process control and color deviation correction use. Specifically, the photo-sensor 11 is arranged downstream of the fixing unit 66 opposing a conveyance path for a recording medium P.

Since a photo-sensor 10 for replacement unit specification use is separately employed from that for process control and color deviation correction use, a number of sensors increases. However, it is advantageous that quality of an image can be determined at a final stage after completion of a fixing process, and accordingly, precision of specification of the replacement unit is increased. The photo-sensor 11 can detect the entire region of an image formation region as the photo-sensor as described in the first embodiment. The photo-sensor 11 does not necessarily cover the entire region in the lengthwise direction, and can only cover one end thereof in the direction.

Now, with reference to FIG. 12, an exemplary sequence of specifying a replacement unit in the second embodiment is described. The sequence includes a step S105 in addition to the steps of the first embodiment of FIG. 8. In an image forming apparatus 100, since the photo-sensor 11 reads an image after a fixing process, image deterioration caused by the fixing unit 66 can be detected.

Thus, when the image deterioration is not recognized after the fixing process in step S102, determination sometimes indicates that no replacement unit is recommended to be replaced, and such a result is displayed in step S103. Further, when no replacement unit exists, the lock mechanism is not released.

Specifically, as shown in FIG. 12, a CPU 9*a* periodically checks a memory device 9*b*, and determines if information stored in the memory region corresponding to abnormality notification information indicates the numeral one in step S101. If the information indicates numeral zero, the negative determination is provided in step S101, and the CPU 9*a* simply repeats the checking. In contrast, if the information indicates numeral one, the sequence enters an operation for specifying a replacement unit in step S102, and a result thereof is displayed on a liquid crystal panel 8*a* in step S103.

As mentioned earlier, the specification device of the first embodiment also determines if a replacement unit to be replaced to resolve abnormality exists when the abnormality notification button 8*b* is depressed. And, information about replacing of a replacement unit specified by the specification device is notified to the liquid crystal panel 8*a*, when it is determined by the specification device that the replacement unit to be replaced exists. Whereas when the unit specification device determines that no replacement unit exists, such an effect is notified to the liquid crystal panel 8*a*. Specifically, a replacement unit recommended to replace is either specified in accordance with algorithm of FIG. 14 as mentioned later. Thus, display as a result of execution of step S103 sometimes includes not only a name of a replacement unit or a manner of replacing thereof as shown in FIG. 9, but also an effect that no replacement unit exists as shown in FIG. 13. Beside the effect of none of the replacement units, every possible problem (and countermeasure) can be listed and displayed as well as a manner of contacting a service station. This is because, such information is useful for the user to determine the next action based on the above-mentioned additional information.

Then, it is determined if the replacement unit to be replace exits in step S105. If the determination is positive (Yes), a signal is transmitted to a lock control section 9*d* as shown in FIG. 9, and the replacement unit to be replaced is unlocked in step S104.

Whereas if the determination is negative (No), the operation is completed.

Now, the step S102 of FIG. 12 is described in more detail with reference to FIG. 14. A position of a photo-sensor 11 is different from that of FIG. 8. However, algorithm running in step S102 and pattern analysis executed in step S102*c* are the same as in the first embodiment of FIG. 8. A difference from that in FIG. 8 is that step S102*n* is executed instead of step S102*l*, and step S102*p*, instead of step 102*m*, respectively. In step 102*n*, all of color patterns are determined if including abnormality. Specifically, respective process unit replacement flags are read from the memory device 9*b* and are subjected to the AND calculation. When the calculation result indicates numeral one, positive determination (Y) is provided, when numeral zero, negative determination (N) is provided, respectively. A process is completed if the negative determination (N) is provided. If the positive determination (Y) is provided, replacement of a fixing unit is recommended while recommendation of replacing a process unit is cancelled in step S102*p*. Specifically, respective process unit replacement flags in the memory device 9*b* are overwritten by numeral zero. This is because, when it is determined that all of color patterns include abnormality, the fixing unit practically more highly provably includes a problem than all of color patterns include problems.

According to the second embodiment, when the user recognizes abnormality in either the output image or the image forming apparatus 100 and desires to resolve the abnormality, as well as depresses an abnormality notification button 8*b*, a replacement unit to be replaced to resolve the abnormality is specified while information related to the replacement unit is notified. Thus, when the user feels the abnormality in either the output image or the image forming apparatus, maintenance can be accurately performed without loss of time.

Figure 15:
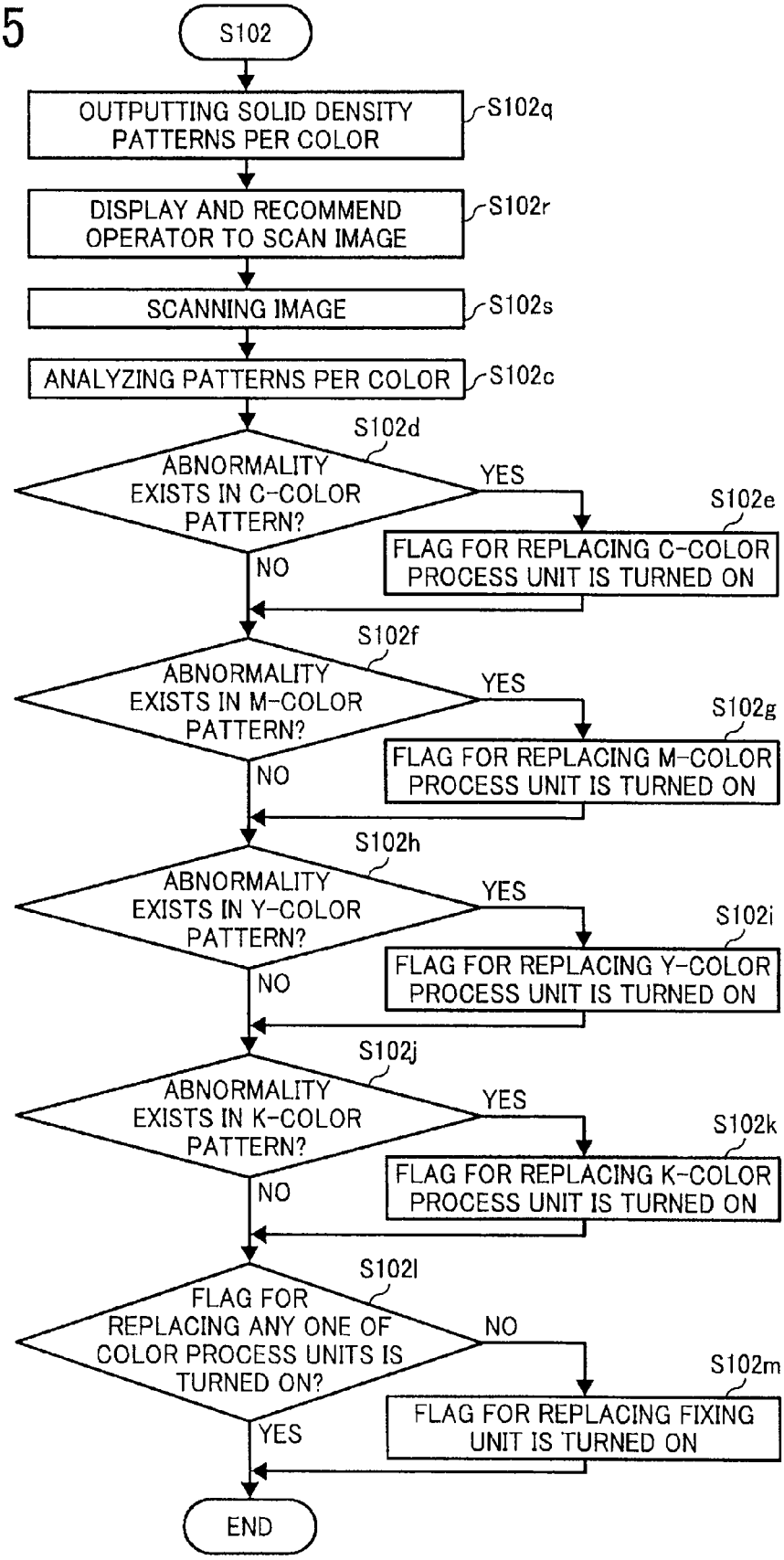
FIG. 15 illustrates an exemplary sequence of abnormality notification executed in an image forming apparatus according to the third embodiment of the present invention.

Now, the third embodiment is described with reference to FIG. 15. As shown, an exemplary sequence control executed when abnormality is notified in an image forming apparatus 100 according to the third embodiment is described.

A difference from the second embodiment is that instead of a photo-sensor 11, a scanner 7 is employed as an image-reading device for reading a toner image for image quality determination use formed to specify a replacement unit.

Specifically, a pattern image for replacement unit specification use is formed on a recording medium P. Then, such a pattern image is outputted and set to the scanner 7 by a user, so that the scanner scans the pattern image. A replacement unit is specified based on image data obtained by the scanning. The entire sequence is as same as that in FIG. 12. An exemplary sequence executed in step S102 is illustrated in FIG. 15, wherein a difference from that in FIG. 14 is that three steps S102*q*, S102*r*, and S102*s* are executed instead of steps S102*a* and S102*b*. In step S102*q*, a solid density pattern is outputted from the image forming apparatus 100 per color. The output represents that image formation is completed including a fixing process as same as a printed out image as in ordinary image formation.

Then, in step S102*r*, messages are displayed on the liquid crystal panel 8*a*. The messages include languages that "please set and scan an output image on a platen glass". To read image data of the output image, an ADF (automatic document feeder) or the like can be used. To have a user read the output image with a scanner, an instruction device may be employed to instruct the user to do so using sound beside the operation panel 8. Then, in step S102*s*, an image for image quality determination use is scanned. The scanning is executed as in an ordinary copying operation. Specifically, the user may depress a start key after setting an image on either the platen glass or the ADF. In step S102*s*, the image forming apparatus 100 actually executes scanning in accordance with an ordinary scanning instruction from the user. In this way, the image outputted once is manually set to the scanner 7 by a user, and the scanner 7 reads the image. Thus, the image-reading device can advantageously be omitted from the image forming apparatus 100.

As mentioned heretofore in the third embodiment, when the user recognizes abnormality in either the output image or the image forming apparatus 100 and desires to resolve the abnormality, as well as depresses an abnormality notification button 8*b*, a replacement unit to be replaced to resolve the abnormality is specified while information related to the replacement unit is notified. Thus, when the user feels the abnormality in either the output image or the image forming apparatus 100, maintenance can be accurately performed without loss of time.

Figure 16:
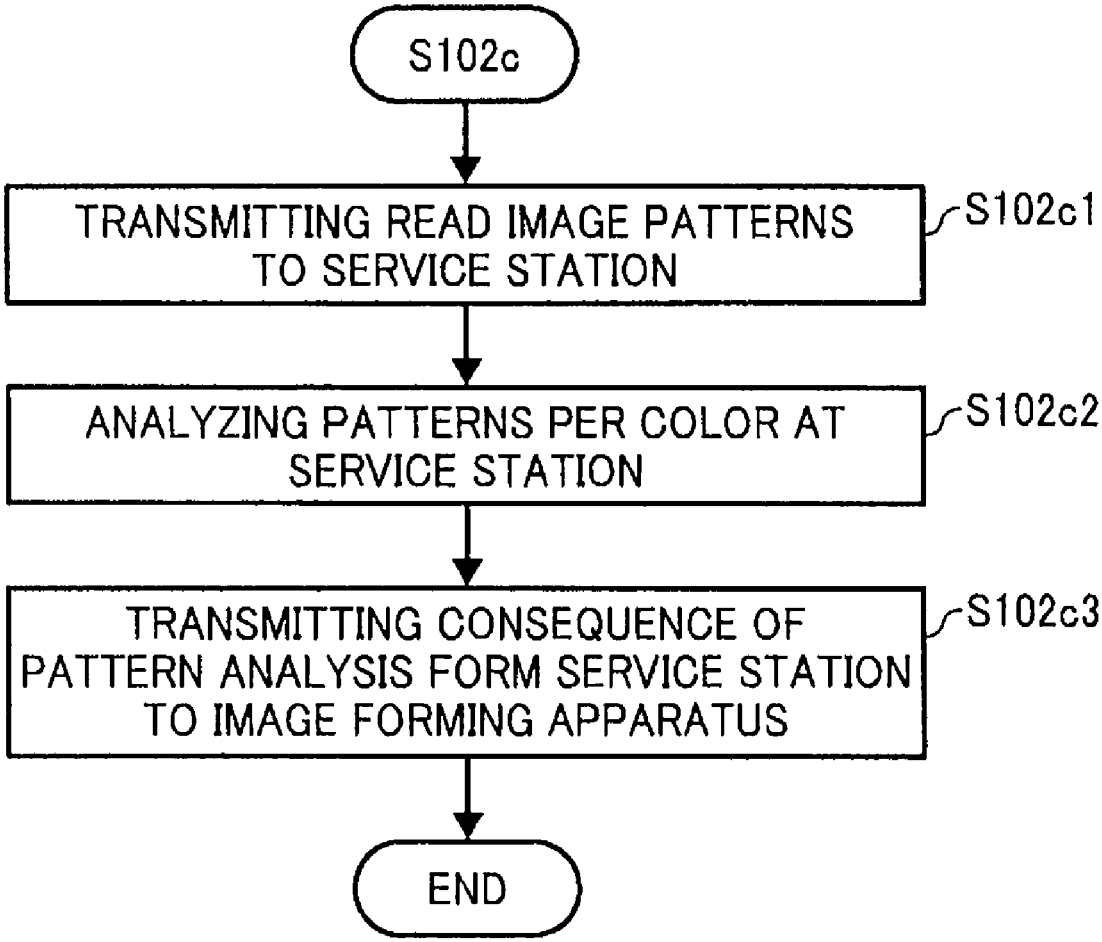
FIG. 16 illustrates an exemplary sequence of abnormality notification executed in an image forming apparatus according to the fourth embodiment of the present invention.

Now, the fourth embodiment is described with reference to FIGS. 16 to 20. FIG. 16 illustrates an exemplary sequence of abnormality notification executed in the image forming apparatus 100 according to the fourth embodiment.

Figure 17:
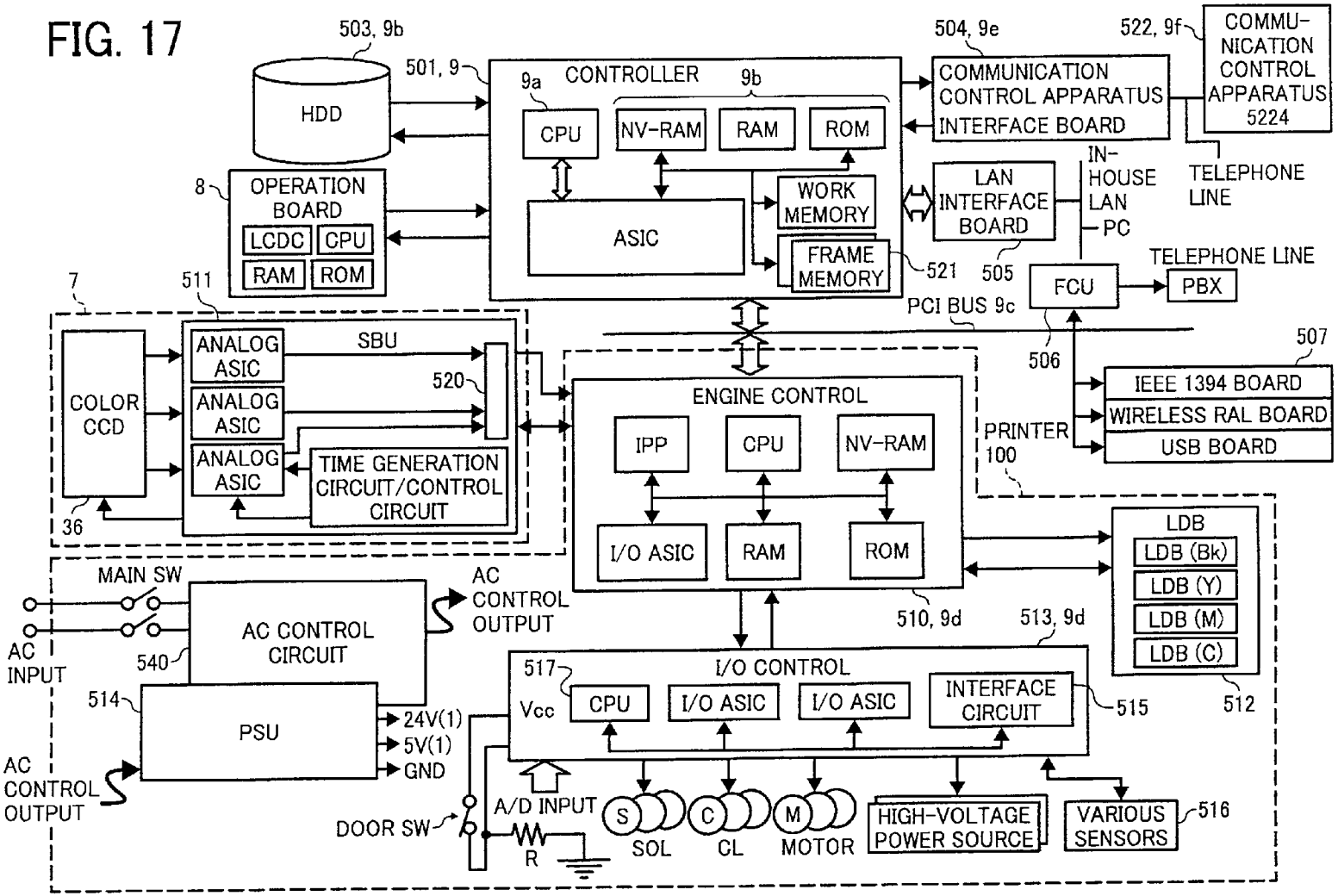
FIG. 17 illustrates an exemplary configuration of an electric system.
Figure 18:
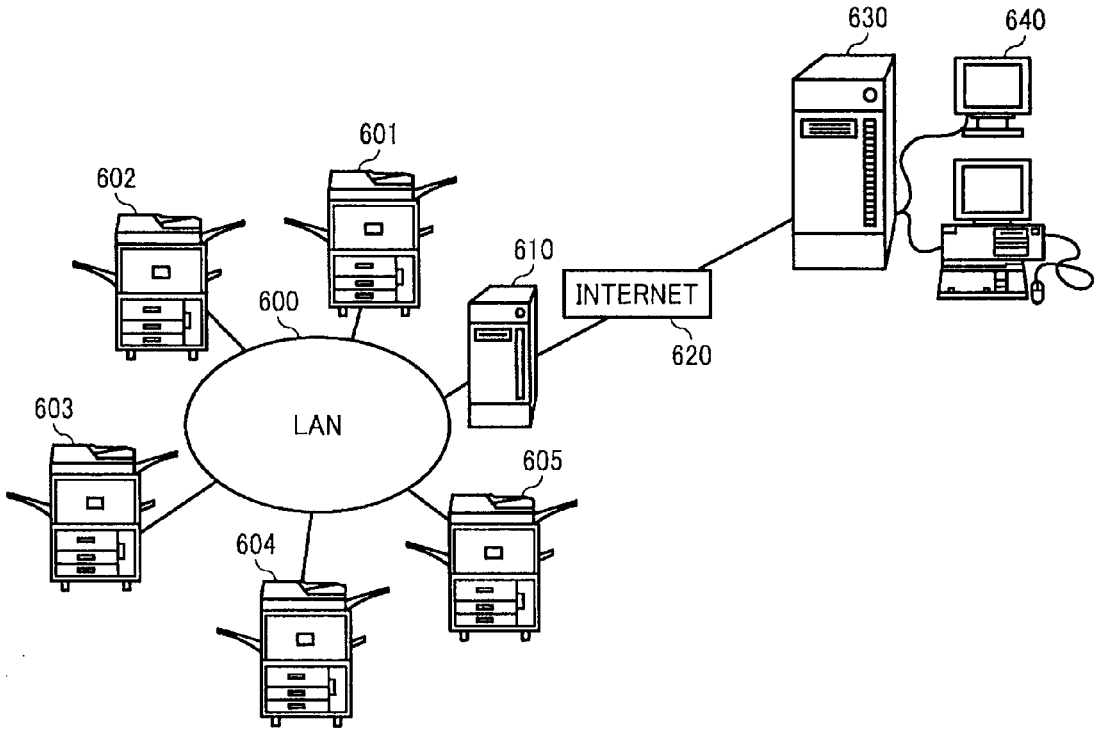
FIG. 18 illustrates an exemplary control system.

FIG. 17 illustrates an exemplary configuration of an electric system. FIG. 18 illustrates an exemplary control system. In this embodiment, a control system is formed by connecting an image forming apparatus 100 to a control apparatus, wherein a specification device for specifying a replacement unit to be replaced upon notification of abnormality is installed in the control apparatus.

In the image forming apparatus 100 of the fourth embodiment and similar to the other embodiments, an abnormality notification button 8*b* for notifying an effect that a user recognizes and wishes to resolve an abnormality of an output image or an apparatus, and a liquid crystal panel 8*a* for notifying the user of various information are arranged. When an input is provided through the abnormality button 8*b* in the image forming apparatus 100, a replacement unit to be replaced to resolve the abnormality is specified in the control apparatus. Then, in accordance with the specification result in the control apparatus, information related to a replacement unit to be replaced is notified on the liquid crystal panel 8*a* of the image forming apparatus 100.

A control sequence executed in the image forming apparatus 100 is essentially similar to that described with reference to FIGS. 10, 14, and 15. However, a method of analyzing patterns per color executed in step S102*c* is different therefrom. Specifically, the step S102*c* includes three segmented sub steps. Initially, an image pattern read by an image reading device or a scanner is transmitted to a control apparatus in a service station via a communications line in step s102*c*. At the service center, a replacement unit is specified using algorithm similar to that used by the determination device in the CPU as described in the first embodiment. Specifically, the determination device of this embodiment is installed in a server of the control apparatus connected to the network, outside the image forming apparatus 100. Then, the service station transmits a result of pattern analysis to the image forming apparatus 100 in step S102*c*3, and step S102*c* is terminated. Hence, since complex algorithm for specifying a replacement unit can be installed in an external server of the control apparatus, calculation load on the image forming apparatus 100 decreases and an expensive CPU is not needed therefor.

FIG. 17 illustrates an exemplary configuration of an electric system. The electric system includes a system controller 501 for generally controlling an image forming apparatus 100, which corresponds to the controller 9 of FIG. 7, an operation panel 8 connected to the controller 501, a HDD 503 for storing image data, which corresponds to the memory device 9*b* of FIG. 7, and a communications control apparatus interface board 504 for executing communications with external devices using an analog line, which corresponds to the MODEM 9*e* of FIG. 7. Also included are a LAN interface board 505, a control unit (FCU) 506 connected to a multipurpose PIC bus, an IEEE 1394 board 507, a wireless LAN board, and a USB board or the like. Still further included are an engine controller 510 connected to a controller using a PCI buss, which corresponds to the lock control section 9*d* of FIG. 7, an I/O control board 513 connected to the engine controller 510 for controlling I/O of the image forming apparatus, which corresponds to the lock control section 9*d* of FIG. 7, a scanner board (SBU: Sensor Board Unit) 511 for reading a copy original document (i.e., an image), and a LDB (Laser Diode Board) 512 for emitting image light modulated by image data onto a photoconductive drum or the like.

In such a configuration, an effect of an operation of the abnormality notification button 8*b* arranged on the operation board 8 is immediately notified to the external control apparatus. The control apparatus specifies a replacement unit and notifies a user of the specification result. As the communications device, which releases an applicable lock mechanism for executing a replacement of a replacement unit, a communication control apparatus interface board 504 can be employed. The communication device can be used to transmit a usage condition of the image forming apparatus or the like beside the usages as described in the fourth embodiment. Further, the communication device can be connected to a prescribed communication device through an external instrument using a LAN interface board 505.

The scanner 7 optically reads an original document by scanning thereof using an original document emission light source, and forms an original document image (a reflection light from the original document) on a CCD 36. A photoelectric conversion is applied to the original document image in the CCD 36, and RGB image signals are generated. The CCD 36 is a three line color type and generates and inputs RGB signals of Even/Odd pixel channels to an analog ASIC (Application Specific IC) in the SBU (Sensor Board Unit) 511. The SBU 511 includes an analog ASIC, a CCD, and a circuit for generating a driving time for the analog ASIC. An output from the CCD 36 is subjected to a sample hold in a sample hold circuit arranged in the analog ASIC, and is subjected to an A/D conversion, thereby converted into RGB image data. The RGB image data are then subjected to a shading correction process and is launched to an image data process IPP via the image data buss in the output I/F (interface) 520.

The IPP of the engine controller 510 serves as a programmable calculation processing device for executing image processing, such as separation generation (i.e., image area separation by determining if an image is a character region or a photograph region:), removal of background stein, scanner gamma conversion, filtering, color correction, magnification, image processing, printer gamma conversion, halftone processing, etc.

Deterioration of signals (e.g. signal deterioration of a scanner system) of the image data transferred from the SBU 511 to the IPP, which is caused by the optical system or created as a result of quantizing to a digital signal is corrected by the IPP, and is written into a frame memory 521. The system controller 501 includes a CPU, a ROM for controlling a system controller board, a RAM as a working memory used by the CPU, a NV-ROM including a lithium battery and a timer for executing backup of the RAM, an ASIC for executing system control of the system controller board, a frame memory, a CPU periphery of the FIFO, and an interface circuit or the like. The system controller 501 includes plural functions, such as scanner application, facsimile application, printer application, etc., and executes general control of the entire system. The system controller 501 deciphers an input to the operation board 8 and displays settings to the system and conditional information of the system on the operation board 8. Many units are connected to the PCI bus, and image data and control command are transferred thereto in a timeshare manner.

The communication control apparatus interface board 504 serves as an interface between the communication control apparatus 522 and the controller 501. Communications with the controller 501 are connected by means of full duplex asynchronous serial communications. Multi-drop connection is provided to the communication control apparatus 522 (which corresponds to a NCU 9*f* of FIG. 7) pursuant to the RS-485 interface standard. Communications with the remote control apparatus 630 as shown in FIG. 18 is executed via the communication control apparatus interface board 504. The LAN interface board 505 is connected to an in-house LAN 600 as shown in FIG. 18 and serves as an interface between the in-house LAN 600 and the controller 501. Communications with the control apparatus 630 can be executed via the LAN interface board 505.

The HDD 503 is used as an application database for storing application program, and apparatus energizing information for a printer and image formation process devices. The HDD 503 is also used as an image database that stores image data and document data of read and write images. The HDD is connected to the controller via physical and electrical interfaces pursuant to the ATA/ATAP1-4 standard. The operation board 8 includes an ASIC (LCDC) for controlling a CPU, a ROM, a RAM, a LCD, and key inputs. The ROM stores control program for the operation board 8 to read an input and display an output. The RAM serves as a work memory used by the CPU. The ASIC controls use's input of system settings through the panel and display to the user of the system settings on the panel while communicating with the system controller 501.

Respective color write signals of black, yellow, cyan, and magenta (K, Y, C, and M) outputted from the work memory of the system controller 501 are inputted to LD (Laser Diode) write circuits of K to C in the LDB (Laser Diode control Board), respectively. The write signals are subjected to LD current control (i.e., modulation control) executed in the LD write circuit and are outputted to the respective LDs. The engine controller 510 serves as a system controller, and mainly executes image formation control, and includes a CPU, an IPP, a ROM for storing program for controlling a copier and printing, and a RAM such as a NV-RAM for controlling the ROM. The NV-RAM includes a SRAM and a memory for storing data in an EEPROM when detecting turn off of a power supply. The I/OASIC also includes a serial interface for executing signal communications with the CPU that executes another control. The I/OASIC includes an engine control board and controls neighboring I/Os (such as a counter, a fan, a solenoid, a motor, etc.). The I/O control board 513 and the engine control board 510 are connected to each other in the manner of the synchronous serial interface connection. The I/O board 513 includes a sub CPU 517 and reads detection signals of various sensors, such as temperature sensor, a potential sensor, a photo conductive drum surface density sensor (a Photo-sensor) as a toner amount sensor, a toner density sensor, etc. The I/O board 513 detects sheet jam with reference to a detection signal detected by the sheet sensor, and executes I/O control for the image forming apparatus including sheet conveyance control. The interface circuit 515 serves as an interface between various sensors and actuators (e.g. a motor, a clutch, a solenoid). The above-mentioned photo-sensors 10 and 11 are included in the various sensors 516. The above-mentioned driving source for driving the lock mechanism is included in a motor, a solenoid, or a clutch.

The power supply apparatus (PSU) 514 supplies power that controls the image forming apparatus. When a main switch is turned on (e.g. closed), power is supplied from a commercial use power supply. The commercial use power supply supplies a commercial AC to an AC control circuit. A power supply apparatus 514 supplies a prescribed DC voltage to respective control substrates using an output rectified or smoothed by the AC control circuit 540, for example. The CPUs of the respective control sections are operated by using a constant voltage generated by the power supply apparatus (PSU) 514. The image forming apparatus 100 includes a data-acquiring device for acquiring various information related to phenomena caused inside or state of its structural elements. The data-acquiring device includes an engine controller 510, an I/O controller 513, various sensors 516, and an operation board 8 or the like. Otherwise, the data-acquiring device includes a scanner for scanning image information. The engine controller 510 controls the entire hardware of the image forming apparatus. The engine controller 510 includes a ROM serving as a data memory for storing control program, a RAM serving as a data memory for storing calculation data and control parameter, and a CPU serving as a calculation device. The image forming apparatus 100 is configured such that the data-acquiring device includes the engine controller 510, the I/O controller 513, and the various sensors 516. Further, the operation board 8 detects various statuses at a prescribed time in step S102 of FIGS. 10, 14, and 15, and generates data for specifying a replacement unit. The operation board 8 then notifies the control apparatus via the controller 501.

FIG. 18 illustrates an exemplary control system. Plural image forming apparatuses 601 to 605 are connected to the in-house LAN 600 (Network) and an in-house server 610. The image forming apparatuses are further connected to the control apparatus 630 (i.e., a PC 640) arranged at a remote site (e.g. a service station) via the Internet 620. In the control system thus constructed, communications, such as acknowledge receipt accompanying an operation of the abnormality notification button of the image forming apparatus, are executed between such apparatuses. Also, algorithm for specifying a replacement unit is executed. The communications line connecting the image forming apparatuses 601 to 605 and the control apparatus 630 can be entirely or partly wireless.

Figure 19:
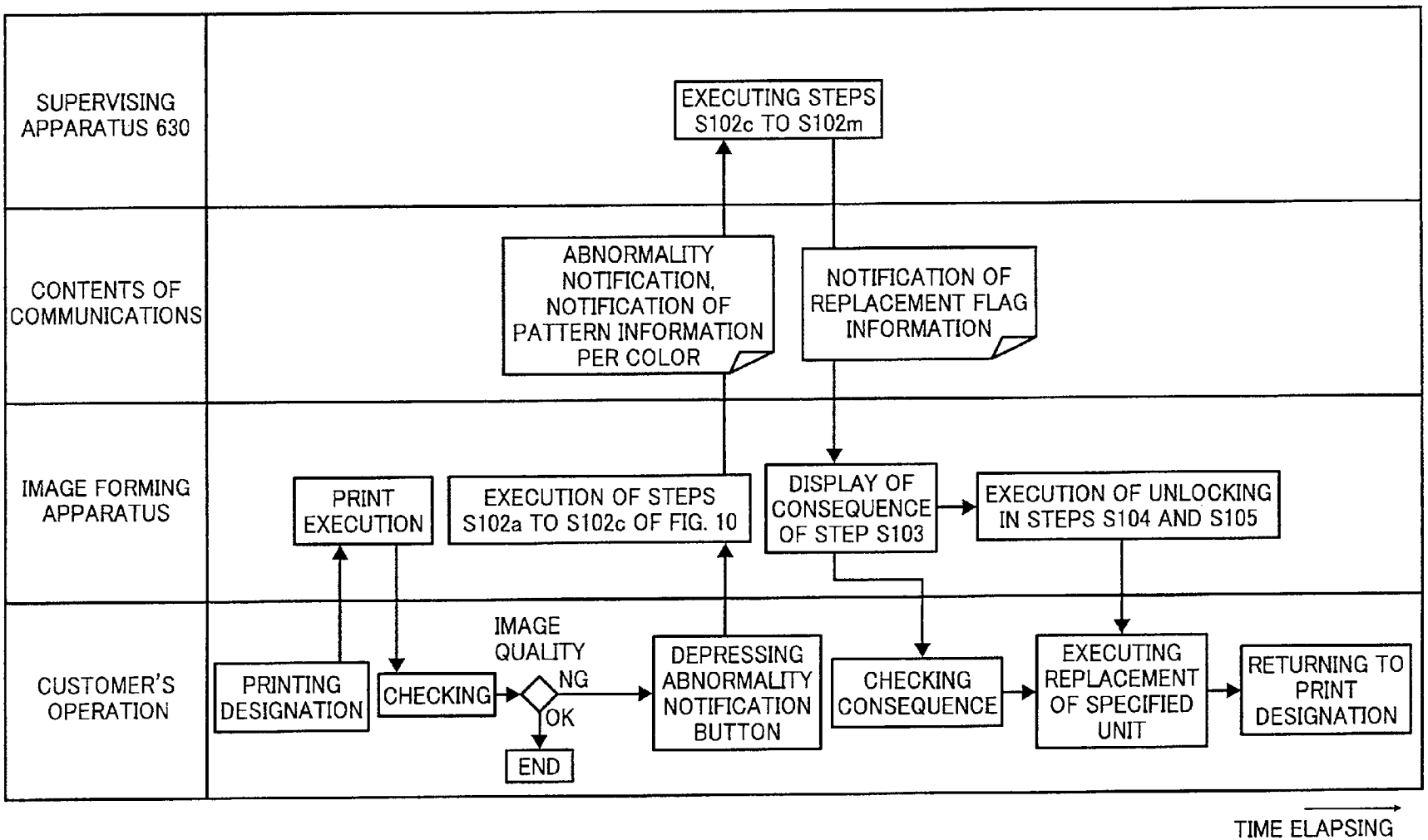
FIG. 19 illustrates an exemplary sequence of communications between apparatuses and algorithm.

FIG. 19 illustrates an exemplary communications between the apparatuses and a sequence of algorithm. Using the methods of specifying a replacement unit as described in the first embodiment, the image forming apparatus obtains pattern information per color, while the control apparatus 630 executes pattern analysis after that. There is generally a suitable analyzing method in accordance with an abnormality image mode. Further, when the algorithm for analyzing the abnormal image mode is improved, analysis precision can be increased. Thus, when an appropriate pattern analysis method is added or improved algorithm is reflected after a user starts using the image forming apparatus corresponding to a new type of an abnormal image mode, it is not needed to update the algorithm per apparatus. That is, algorithm of the control apparatus is only needed to update. Thus, precision of specification of a replacement unit for every image forming apparatuses can be improved. Further, a history of replacement and repair can be kept per image forming apparatus, and is used when a replacement unit is previously distributed to a user or when a bill is automatically prepared. The replacement unit specification method of the second embodiment can be utilized in the above.

Figure 20:
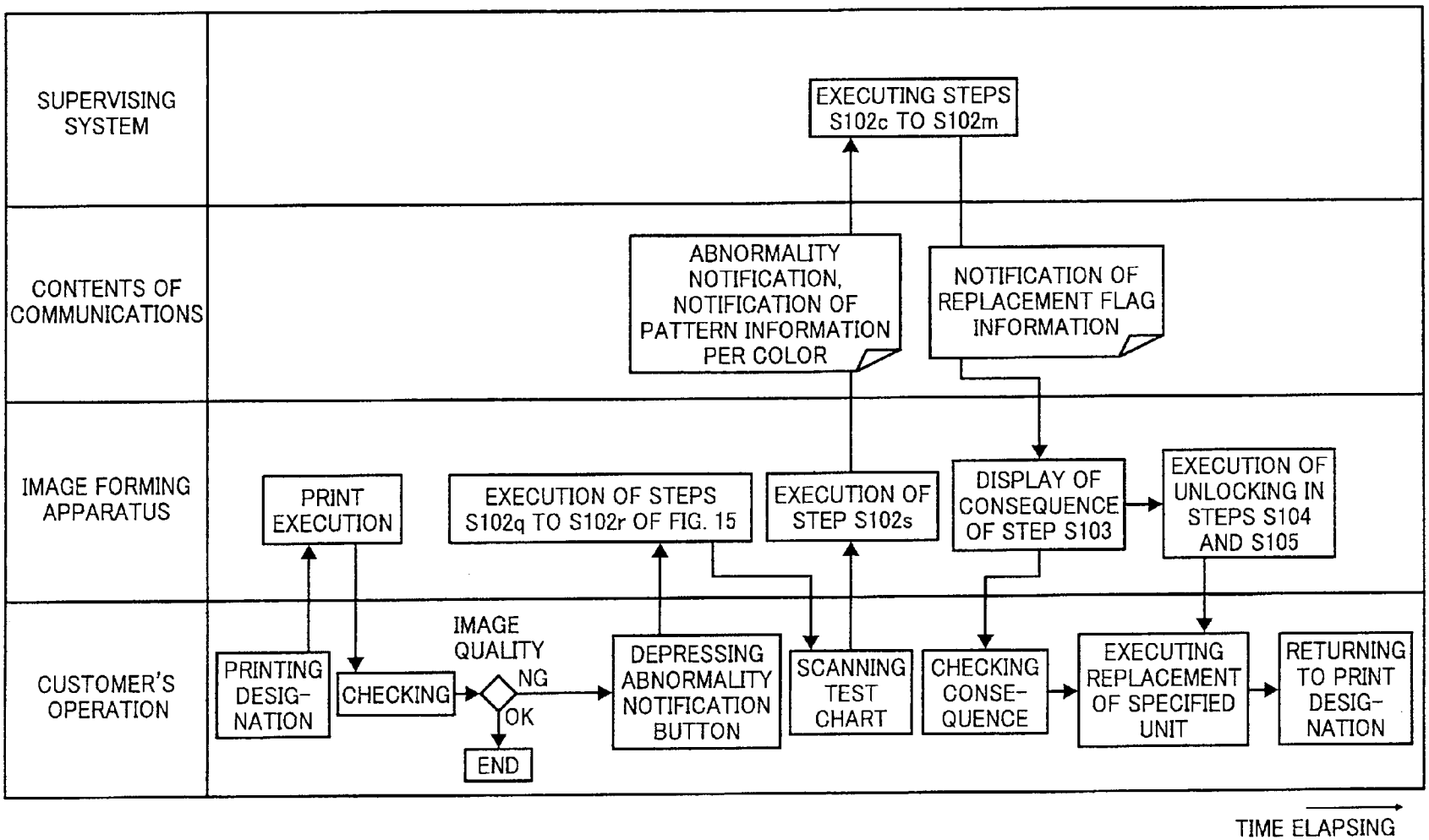
FIG. 20 illustrates another exemplary sequence of communications between apparatuses and another algorithm.

FIG. 20 illustrates another exemplary communications between the apparatuses and a sequence of algorithm. As shown, the replacement unit specification method of the third embodiment is utilized. Specifically, the user obtains an automatically printed test chart by depressing an abnormality notification button 8*b*. The test chart includes an image formed on a recording medium P for image quality determination use. The user causes a scanner to read the test chart and send reading result to the control apparatus 630. The test chart of image data can handle more various image conditions in comparison with a pattern read by the density sensor. In comparison with a detection performance of the density sensor, the scanner 7 is more excellent in resolution and halftone performance, and is capable of detecting the entire image formation region. Thus, a replacement unit can be accurately specified based on a great amount of information in one hand. On the other hand, since the great amount of information is handled, functions unrelated to a replacement unit, such as scanning, sending facsimiles, etc., are restricted when a calculation performance of the controller 501 included in the image forming apparatus is used. In the fourth embodiment, since the test chart analysis algorithm handling such a great amount of information is executed by the control apparatus 630, the above-mentioned problem is suppressed. Further, updating the algorithm in the control apparatus causes the same advantage as above.

As mentioned heretofore including the above-mentioned respective embodiments, when the user recognizes abnormality in either the output image or the image forming apparatus and desires to resolve the abnormality, as well as depresses an abnormality notification button 8*b*, a replacement unit to be replaced to resolve the abnormality is specified while information related to the replacement unit is notified. Thus, when the user feels the abnormality in either the output image or the image forming apparatus, maintenance can be accurately performed without loss of time.

Now, the fifth embodiment is described with reference to FIGS. 21 to 23. As shown, a replacement unit specification method in this embodiment is only different from that of the first embodiment in that this embodiment does not use a photo-sensor 10 (an image reading device) when a determination device specifies a replacement unit.

Specifically, the determination device of this embodiment detects deterioration of the photo conductive drum 21 based on an amount of electric current flowing through the shaft of the photo conductive drum 21 in accordance with a charging current. The photo conductive drum 21 includes a substrate made of aluminum grounded and a photo conductive layer overlying the substrate. The photo conductive layer deteriorates as time elapses when the process unit 20 is used. For example, the photo conductive layer of the photo conductive drum 21 becomes thinner because of shaving of a film due to a component of an alternating current applied in a charging process.

Figure 21:
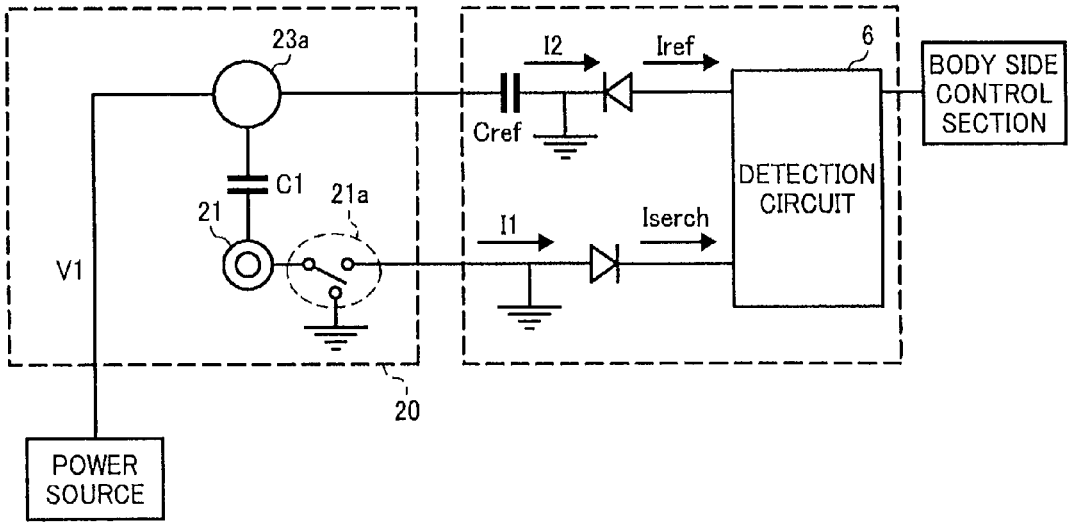
FIG. 21 partially illustrates an exemplary electric circuit of an image forming apparatus according the fifth embodiment of the present invention.

Then, as shown in FIG. 21, the substrate of the photo conductive drum 21 is selectively grounded or is not grounded to be a floating state (i.e., no potential is applied) by a switch 21*a*. The photo conductive drum 21 in the floating state and the developing roller 23*a* can be collectively regarded as a condenser. Hereinbefore, a capacitance of the condenser is referred to as C1. When a developing bias is applied from a power supply of the image forming apparatus to the developing roller 23*a*, the substrate of the photo conductive drum 21 also induces prescribed electric charge. The amount of induced electric charge Q is in proportion to the capacitance (i.e., Q=C1*x* V) as far as a difference V of potential between the substrate of the photo conductive drum 21 and the developing roller 23*a* is constant. Since the amount of C1 changes in accordance with a dielectric constant of substance existing between the substrate of the photo conductive drum 21 and the developing roller 213*a*, the dielectric constant changes as far as an amount of developer intervening the substrate of the photo conductive drum 21 and the developing roller 213*a* is constant. Specifically, the amount of C1 is related to a thickness of the photo conductive roller.

Specifically, by detecting the amount of electric charge induced in the substrate of the photo conductive drum 21, a thickness of the photo conductive layer can be detected via the capacitance C1. A mechanism for detecting the electric charge amount Q induced in the substrate of the photo conductive drum 21 is described with reference to FIG. 21 in detail. As shown, the image forming apparatus of this embodiment includes a power supply for applying a voltage V1 to the developing roller 23*a*. The power supply is the same as used in a developing process. When the voltage V1 is applied, a prescribed voltage is generated at both ends of the condenser C1, so that a current I1 flows. The current I1 flows into a detection circuit 6 via a rectification circuit, and a current Iserch obtained by only extracting a positive value section of the current I1 reaches the detection circuit 6.

On the other hand, the voltage V1 applied to the developing roller 23*a* is also applied to a reference use condenser Cref. Thus, a prescribed voltage is created at both ends of the reference use condenser Cref, so that a current I2 is generated. The reference use condenser Cref is connected to the detection circuit 6 via the rectification circuit. A current Iref obtained by only extracting a negative section of the current I2 reaches the detection circuit 6. The reference use condenser Cref is employed to prevent deterioration of detection precision due to variant of the developing bias.

Figure 22:
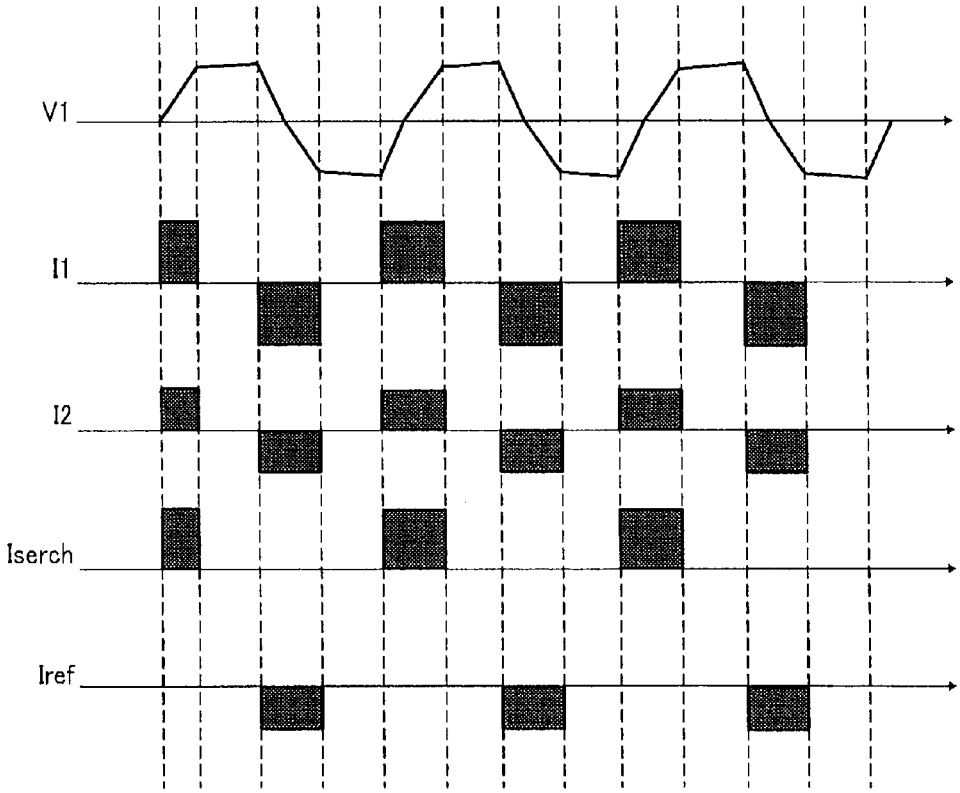
FIG. 22 illustrates an exemplary operation of detecting electrostatic capacity of a circuit of FIG. 21.
Figure 23:
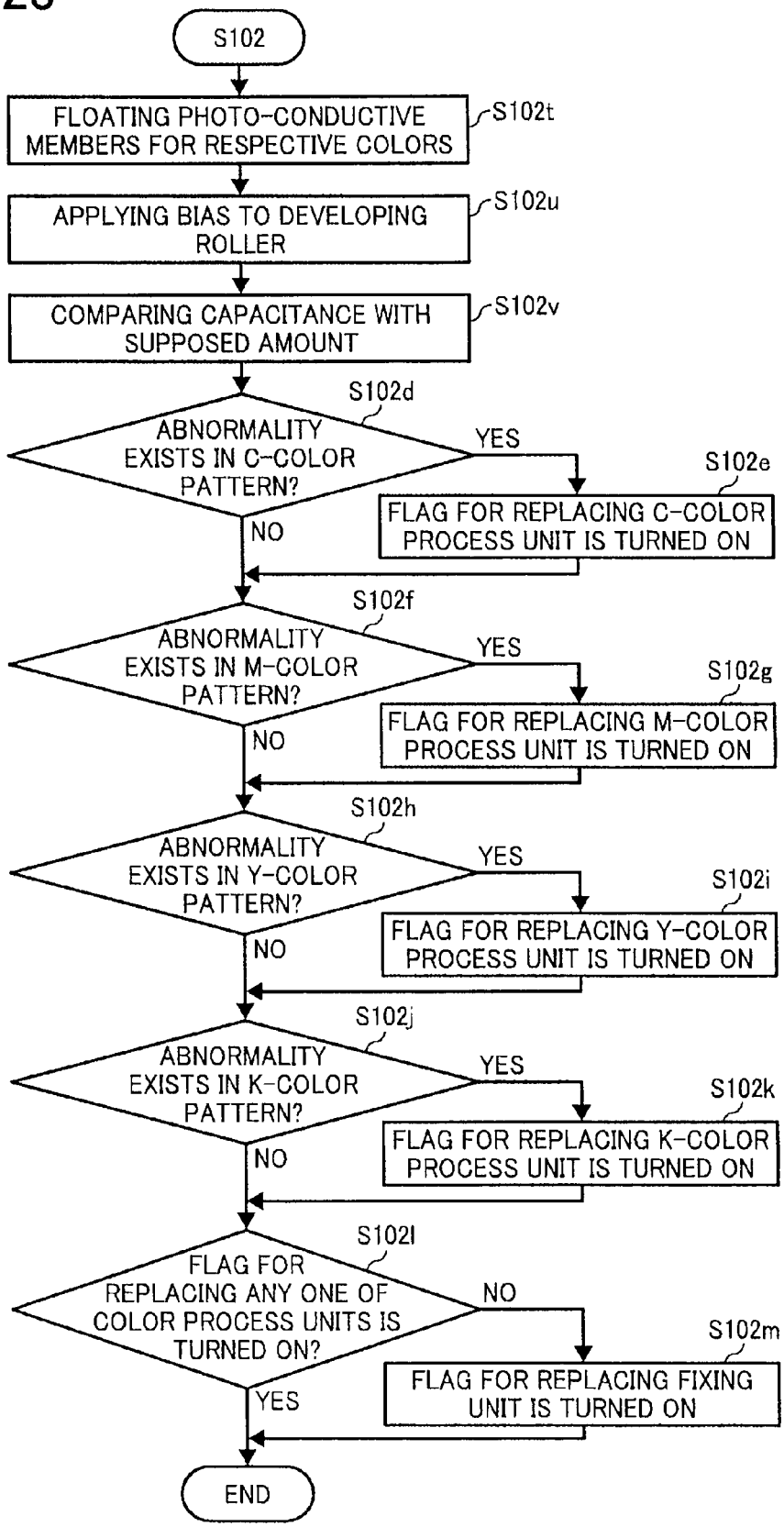
FIG. 23 illustrates an exemplary sequence of abnormality notification.

With reference to FIG. 22, a method of calculating the capacitance C1 based on the currents Iserch and Iref is described. As shown, since an alternating current bias is applied as a voltage V1, the voltage V1 forms an alternating current wave. Since the condenser C1 induces electric charge when the voltage V1 changes, the current I1 is induced having positive and negative values when the voltage V1 rises and declines, respectively. Since only the positive value among the current I1 passes through the rectification circuit, the current Iserch appears as shown in the drawing. When a frequency of the V1 of an AC bias is f (Hz), and the amplitude thereof is Vp (V), Iserch (sum) as integration of the Iserch arriving at the detection circuit 6 per hour is calculated by the following formula:

$$Iserch(\text{sum})=f\times VP\times C1$$

Iref (Sum) as integration of the Iref arriving at the detection circuit 6 per hour is calculated by the following formula:

$$Iref(\text{sum})=-f\times Vp\times Cref$$

Since the sum (Iserch+Iref) reaches the detection circuit 6, integration thereof per hour is calculated by the following formula:

$$Iserch(\text{sum})+Iref(\text{sum})=f\times Vp\times(C1-Cref) \qquad \text{(First Formula)}$$

Accordingly, if the integration of the current (Iserch (sum)+Iref (sum)) arriving at the detection circuit 6 per hour is known, the value of C1 can be calculated using the first formula.

Now, a replacement unit specification sequence executed in step S102 using the above-mentioned method is described with reference to FIG. 23. A difference from the sequence in the FIG. 10 is that steps S102*t* to S102*v* are executed instead of those of S102*a* to 102*c*.

Specifically, in step S102*t*, a photo conductive drum 21 becomes a floating condition upon an operation of a switch 21*a*. Then, an alternating current voltage is applied to the developing roller while the photo-conductive drum 21 and the developing roller 23*a* are rotated similar to image formation in step S102*u*. To prevent toner from moving to the photo conductive drum 21, the photo conductive drum 21 is charged as in the image formation. Then, a capacitance of the photo conductive layer of each of the respective color photo conductive drums is calculated using the first formula.

In steps S102*d*, S102*f*, S102*h*, and S102*i*, presence of the abnormality is determined based on the capacitance different from the first embodiment in which determination is made based on the density data. Specifically, an appropriate range of the capacitance of each of the respective photo conductive drum 21 is previously stored in the memory device 9*d*, and it is determined if the capacitance calculated using the first formula is within the appropriate reference range. When the upper limit of the appropriate reference value is Cmax and the lower limit thereof is Cmin, the determination is executed by the below described four steps. In step one, it is determined if C1 is smaller than Cmax, and a flag 1 is assigned numeral value one when the C1 is smaller, and assigned zero, when larger, respectively. In step two, it is determined if C1 is larger than Cmin, and a flag 2 is assigned numeral value one when the C1 is larger, and assigned with zero when smaller, respectively. In step three, an AND calculation is applied to the flags 1 and 2. In step four, if the calculation result indicates numeral one, it is determined as normal (i.e., No, in steps S102*f*, S102*h*, and S102*i*), and abnormal when zero (i.e., Yes, in steps S102*d*, S102*f*, S102*h*, and S102*i*), respectively.

Since the appropriate reference range of the capacitance of each of the respective photo-conductive drums varies based on a process unit as mentioned earlier, it is preferable that the range is previously stored in a memory such as an IC chip arranged in the process unit, and the image forming apparatus reads storage information every time when a replacement unit is to be specified. Further, the replacement unit specification method of the fifth embodiment and the earlier described embodiments can be combined. In such a situation, a replacement unit can be replaced based on the one or two of the same specification results.

As mentioned heretofore including the fifth embodiment, when the user recognizes abnormality in either the output image or the image forming apparatus and desires to resolve the abnormality, as well as depresses an abnormality notification button 8*b*, a replacement unit to be replaced to resolve the abnormality is specified while information related to the replacement unit is notified. Thus, when the user feels the abnormality in either the output image or the image forming apparatus, maintenance can be accurately performed without loss of time.

Obviously, numerous additional modifications and variations of the present invention are possible in light of the above teachings. It is therefore to be understood that within the scope of the appended claims, the present invention may be practiced otherwise than as specifically described herein.

What is claimed is:

1. An image forming apparatus for forming an image using a replaceable image formation unit, comprising:

an abnormality signal input device configured to input a signal representing occurrence of abnormality in one of an output image and the image forming apparatus recognized by an operator;

a unit specifying device configured to specify a replacement unit to be replaced to resolve the abnormality upon receiving the signal from the abnormality signal input device;

a notification device configured to notify the operator of information related to the replacement unit in accordance with a result of the specification executed by the unit specifying device; and a lock mechanism configured to lock and prohibit the replacement unit from being removed from the image forming apparatus, said lock mechanism including a moveable member, wherein a controller causes the moveable member to be disposed at a position that prohibits the replacement unit from being removed through an opening in the image forming apparatus while the replacement unit is aligned with the opening, and the controller causes the moveable member to be disposed at another position that allows the replacement unit to be removed through the opening in the image forming apparatus that is aligned with the replacement unit in response to the replacement unit being specified for replacement by the unit specifying device.

2. The image forming apparatus as claimed in claim 1, further comprising:

an image formation device configured to form a toner image for image quality determination use on a transfer belt; and an image reading device configured to read the toner image from the transfer belt for image quality determination use, wherein said unit specifying device determines image quality of the toner image for image quality determination use based on the reading result and specifies a replacement unit to be replaced in accordance with the quality determination.

3. The image forming apparatus as claimed in claim 2, wherein said image reading device includes a photo sensor.

4. The image forming apparatus as claimed in claim 2, wherein said image reading device includes a scanner.

5. The image forming apparatus as claimed in claim 2, wherein the transfer belt is configured to feed an image carrier through the image forming apparatus, and the toner image for the image quality determination use is not printed onto the image carrier.

6. The image forming apparatus as claimed in claim 2, further comprising a controller configured to prevent a sheet feeding section from feeding sheets while the image formation device forms the toner image for image quality determination use on the transfer belt, the image reading device reads the toner image from the transfer belt for image quality determination use, and said unit specifying device determines image quality of the toner image based on the reading result.

7. The image forming apparatus as claimed in claim 1, wherein said notification device notifies information related to the replacement unit including that the replacement unit is not present.

8. The image forming apparatus as claimed in claim 1, wherein the unit specifying device is arranged within the image forming apparatus.

9. The image forming apparatus as claimed in claim 1, wherein the image forming apparatus is connected to an external control apparatus, and wherein said unit specifying device is arranged in the control apparatus.

10. The image forming apparatus as claimed in claim 1, wherein the replacement unit is a developer unit, a fixing unit, or an image formation unit.

11. The image forming apparatus as claimed in claim 1, further comprising a plurality of replacement units, wherein the lock mechanism unlocks and enables detachment of only the replacement unit specified by the unit specifying device while other replacement units are locked and prevented from being detached from the image forming apparatus.

12. The image forming apparatus as claimed in claim 1, further comprising a plurality of replacement units, wherein the lock mechanism unlocks and enables detachment of all of the plurality of replacement units in response to one of the plurality of replacement units being specified by the unit specifying device.

13. The image forming apparatus as claimed in claim 1, wherein the lock mechanism unlocks and enables only the replacement unit specified by the unit specifying device to be detached from the image forming apparatus after a prescribed time period has elapsed after a notification of replacement was displayed.

14. The image forming apparatus as claimed in claim 1, wherein the moveable member is a plate that at least partially blocks the opening through which the replacement unit is withdrawn through while the replacement unit is aligned with the opening.

15. A control system connected to at least one image forming apparatus including at least two replaceable image formation units via a communication line, said control system comprising:

an input device configured to input a signal representing occurrence of abnormality in one of an output image and the image forming apparatus recognized by an operator;

an external control apparatus connected to said at least one image forming apparatus;

a unit specifying device, in the external control apparatus, configured to specify a replacement image formation unit to be replaced to resolve the abnormality upon receiving the signal;

a notification device configured to generate notification information identifying the replacement image formation unit that is to be replaced based on the unit specification result; and a lock mechanism configured to lock and prohibit the replacement image formation unit from being removed from the image forming apparatus, said lock mechanism including a moveable member, wherein the external control apparatus causes the moveable member to be disposed at a position that prohibits the replacement image formation unit from being removed through an opening in the image forming apparatus while the replacement image formation unit is aligned with the opening, and the external control apparatus causes the moveable member to be disposed at another position that allows the replacement image formation unit to be removed through the opening in the image forming apparatus that is aligned with the replacement image formation unit in response to the replacement image formation unit being specified for replacement by the unit specifying device.

16. The control system as claimed in claim 15, further comprising:

an image formation device configured to form a toner image for image quality determination use on a transfer belt; and an image reading device configured to read the toner image from the transfer belt for image quality determination use, wherein said unit specifying device determines image quality of the toner image for image quality determination use based on the reading result and specifies the image formation unit to be replaced in accordance with the quality determination.

17. The control system as claimed in claim 16, wherein the transfer belt is configured to feed an image carrier through the image forming apparatus, and the toner image for the image quality determination use is not printed onto the image carrier.

18. The control system as claimed in claim 15, further comprising a plurality of replacement image formation units, wherein the lock mechanism unlocks and enables detachment of only the replacement image formation unit specified by the unit specifying device while other replacement image formation units are locked and prevented from being detached from the image forming apparatus.

19. The control system as claimed in claim 15, further comprising a plurality of replacement image formation units, wherein the lock mechanism unlocks and enables detachment of all of the plurality of replacement image formation units in response to one of the plurality of replacement image formation units being specified by the unit specifying device.

* * * * *